US005466568A

United States Patent [19]

Kapp et al.

[11] Patent Number: 5,466,568

[45] Date of Patent: Nov. 14, 1995

[54] PHOTOGRAPHIC ELEMENT CONTAINING AN AZOPYRAZOLONE MASKING COUPLER EXHIBITING REDUCED FOG

[75] Inventors: Daniel L. Kapp; Robert J. Ross; Janet N. Younathan, all of Rochester; Stephen P. Singer, Spencerport, all of N.Y.

[73] Assignee: Eastman Kodak Company, Rochester, N.Y.

[21] Appl. No.: 130,071

[22] Filed: Sep. 30, 1993

[51] Int. Cl.[6] ..... G03C 1/08; G03C 7/26; G03C 7/32

[52] U.S. Cl. ..... 430/551; 430/504; 430/546; 430/554; 430/555; 430/558; 430/607; 430/359

[58] Field of Search ..... 430/546, 551, 430/359, 607, 554, 555, 558, 504

[56] References Cited

U.S. PATENT DOCUMENTS

| | | | |
|---|---|---|---|
| 4,132,551 | 1/1979 | Pollet et al. | 430/607 |
| 4,163,670 | 8/1979 | Shiba et al. | 430/555 |
| 4,277,559 | 7/1981 | Jaeken et al. | 430/555 |
| 4,427,763 | 1/1984 | Lohmann et al. | 430/504 |
| 4,977,072 | 12/1990 | Renner et al. | 430/549 |
| 4,992,357 | 2/1991 | Haga et al. | 430/359 |
| 5,238,797 | 8/1993 | Hirabayashi et al. | 430/504 |

*Primary Examiner*—Charles L. Bowers, Jr.
*Assistant Examiner*—Geraldine Letscher
*Attorney, Agent, or Firm*—Arthur E. Kluegel

[57] ABSTRACT

A photographic element and imaging process used therewith provides reduced fogging where the element comprises a light sensitive silver halide layer containing (1) an azopyrazolone masking coupler and (2) a ballasted aromatic nitro compound having a reduction peak potential which is more positive than −1.3 V vs. the Standard Calomel Electrode.

17 Claims, No Drawings

PHOTOGRAPHIC ELEMENT CONTAINING AN AZOPYRAZOLONE MASKING COUPLER EXHIBITING REDUCED FOG

FIELD OF THE INVENTION

This invention relates to photographic elements containing an azopyrazolone masking coupler used to correct for unwanted absorption in color negative film and, in the same layer, a ballasted aromatic nitro compound having a reduction peak potential more positive than −1.3 V vs. the Standard Calomel Electrode (S.C.E.)

BACKGROUND OF THE INVENTION

The use of 4-phenylazopyrazolone masking couplers is known in the art. See ,for example, U.S. Pat. Nos. 2,428,034; 2,434,272; 2,455,170; 2,688,539; 2,704,711; 2,808,329; 3,476,560; 3,796,574; 4,427,763; 4,777,123, and EP 213, 490; as well as those identified in *Research Disclosure* December 1989, Section VII, Part G, Publiched by Kenneth Mason Publications, Ltd., Dudley Annex, 12A North Street, Emworth, Hampshire PO10 7DQ, England. These compounds have proven useful since they are yellow colored in nonexposed areas and magenta colored in exposed areas. Thus, when in reality the magenta dye formed in a color negative photographic process has a small but significant unwanted absorption in the blue range, this may be balanced somewhat by the relative loss of blue absorption due to conversion of the mask color from yellow to magenta in the exposed areas. Then, an adjustment can be made to the spectral content of the light used to produce the positive from the negative to effectively cancel out the unwanted blue absorption which is now relatively constant across both the exposed and unexposed areas of the negative.

While phenylazopyrazolone masking couplers have been employed as a means of offsetting the unwanted blue absorption of conventional magenta couplers, this means for improving the color rendition has now been found to be responsible for increased fogging of the photographic element during processing. This is thought to be due to the formation of a phenyldinitrogen species from the masking coupler during development and/or the presence of undesired reducing agents. This in turn causes the unwanted nonimagewise development of the photographic silver halide contained in the photographic element.

European Patent Application 232,101 discloses a photographic element containing a pyrazolotriazole coupler together with at least 17 mole % of a colored masking coupler that may be of the azopyrazolone type. The presence of the large relative percentage of the masking coupler is said to improve sharpness and grain. There is no suggestion of the advantages to be obtained by including a ballasted aromatic nitro compound and, in fact, the higher concentration of masking coupler suggested would serve to aggravate the fogging problems. U.S. Pat. No. 4,777,123 contains similar general disclosure but again does not suggest the advantage of using the ballasted aromatic nitro compound. U.S. Pat. No. 4,600,688 proposes broad combinations of pyrazolotriazoles and pyrazolones as image couplers having an advantageous color absorption spectrum, but no ballasted aromatic nitro compounds are suggested.

U.S. Pat. No. 4,132,551 describes nitroaromatic compounds useful in photographic elements as antifoggants. The mentioned materials appear to act on the silver of the photographic emulsion to prevent fogging during development at elevated temperature. Nitrobenzene compounds are suggested generally as antifoggants perhaps in combination with azopyrazolones in U.S. Pat. Nos. 4,277,559; 4,977,072; 4,163,670; U.K. Specification 1,269,268; and Research Disclosure 17643 Section VI-I (1975). It is noted however that these suggestions are related to the inclusion of such compounds as general antifoggants in a photographic emulsion where they are believed to adsorb to the silver halide grain surface and prevent nonimagewise reduction of the silver. There is no recognition of the significance of locating the compounds of this invention in the same layer as an azopyrazolone masking coupler to efficiently trap any phenyldinitrogen species that might be formed from the masking coupler and wander toward the photographic silver.

It would be desirable to provide a photographic element and process where an azopyrazolone masking coupler can be used without incurring increased fogging during development and where this can be accomplished without sacrificing other photographic properties such as speed.

SUMMARY OF THE INVENTION

A photographic element and imaging process used therewith provides reduced fogging where the element comprises a light sensitive silver halide layer containing (1) an azopyrazolone masking coupler and (2) a ballasted aromatic nitro compound having a reduction peak potential which is more positive than −1.3 V versus the Standard Calomel Electrode (S.C.E.)

The element exhibits less fog upon development in the presence of the azopyrazolone masking coupler and the result is accomplished without significant degradation of other photographic properties such as speed.

DETAILED DESCRIPTION OF THE INVENTION

The first essential component, the azopyrazolone masking coupler of the invention, can be any such compound that is either colorless or is yellow or cyan and which, in any event, provides a magenta color upon exposure and development. If desired, it may be a so-called shifted masking coupler where the color in the unexposed areas is not evident until processing. The general structure of the masking coupler of the invention is shown in the following formula:

$$Cp—N{=}N—R_3$$

In the formula, Cp represents a 5-pyrazolone magenta coupler residual group (provided, however, that the azo group is attached to the active site of the magenta coupler at the 4-position), and $R_3$ represents an aryl group (including the group having a substituent).

The magenta coupler residual group represented by Cp suitably has the formula:

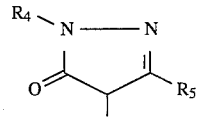

In the formula, $R_4$ represents a substituted or unsubstituted aryl group; $R_5$ represents a substituted or unsubstituted acylamino group, anilino group, alkyl group, amino group, ureido group or carbamoyl group. $R^4$ and $R^5$ typically contain 1 to 42 carbon atoms.

The aryl group represented by $R_4$ is typically a phenyl group. The substituents for the aryl group represented by $R_4$ may include, for example, a halogen atom (for example, fluorine, chlorine, bromine, etc.), an alkyl group (for example, methyl, ethyl, etc.), an alkoxy group (for example, methoxy, ethoxy, etc.), an aryloxy group (for example, phenyloxy, naphthyloxy, etc.), an acylamino group (for example, benzamido, α-(2,4-di-t-amylphenoxy)-butylamido, etc.), a sulfonylamino group (for example, benzenesulfonamido, n-hexadecansulfonamido, etc.), a sulfamoyl group (for example, methylsulfamoyl, phenylsulfamoyl, etc.), a carbamoyl group (for example, an n-butylcarbamoyl group, a phenyl carbamoyl group, etc.), a sulfonyl group (for example, methylsulfonyl, n-dodecylsulfonyl, benzenesulfonyl, etc.), an acyloxy group, an ester group, a carboxyl group, a sulfo group, a cyano group, a nitro group, a trifluoro group, etc.

Specific examples of $R_4$ are phenyl, 2,4,6 -trichlorophenyl, pentachlorophenyl, pentafluorophenyl, 2,4,6-trimethylphenyl, 2-chloro-4,6-dimethylphenyl, 2,6-dichloro-4-methylphenyl, 2,4-dichloro-6 -methylphenyl, 2,4-dichloro-6-methoxyphenyl, 2,6 -dichloro-4-methoxyphenyl, 2,6-dichloro-4-[α-(2,4 -di-t-amylphenoxy)acetamide]phenyl, 2,6-dichloro-4 -dodecysulfonylphenyl, 2,6-dichloro-4-(N-dodecyl)sulfamoylphenyl, 2,4-dichloro-6-trifluoromethylphenyl, etc.

The acylamino (or carbonamido) group represented by $R_5$ may include, for example, pivaloylamido, n-tetradecanamido,α-(3 -pentadecylphenoxy)butylamido, 3-[α-(2,4 -di-t-amylphenoxy)acetamido]benzamido, benzamido, 3 -acetoamidobenzamido, 3-(3-n-dodecylsuccinimide)benzamido, 3-(4-n-dodecyloxybenzenesulfonamide)benzamido, etc.

The anilino group represented by $R_5$ may include, for example, anilino, 2-chloroanilino, 2,4 -dichloroanilino, 2,4-dichloro-5-methoxyanilino, 4 -cyanoanilino, 2-chloro-5-[α-(2,4 -di-t-amylphenoxy)butylamido]anilino, 2-chloro-5-(3 -octadecenylsuccinimide)anilino, 2-chloro-5-n-tetradecanamidoanilino, 2-chloro-5-[α-(3-t-butyl-4 -hydroxyphenoxy)tetradecanamido]analino, 2-chloro-5-n-hexadecansulfoamidoanilino, etc.

The alkyl group represented by $R_5$ may include, for example, methyl, ethyl, dodecyl, t-butyl, s-butyl, etc.

The amino group represented by $R_5$ may include, for example, N-methylamino, N,N-dimethylamino, N-dodecylamino, pyrrolidino, etc.

The ureido group represented by $R_5$ may include, for example, methylureido, phenylureido, 3 -[α-(2,4-di-t-amylphenoxy)butylamido]phenylureido, etc.

The carbamoyl group represented by $R_5$ may include, for example, n-tetradecylcarbamoyl, phenylcarbamoyl, 3-[α-(2,4-di-t-amylphenoxy) acetamide]carbamoyl, etc.

The aryl group represented by $R_3$ is preferably a phenyl group or a naphthyl group.

Substituents for the aryl group $R_3$ may include, for example, a halogen atom, an alkyl group, an alkoxy group, an aryloxy group, a hydroxyl group, an acyloxy group, a carboxyl group, an alkoxycarbonyl group, an aryloxycarbonyl group, an alkylthio group, an arylthio group, an alkylsulfonyl group, an arylsulfonyl group, an acyl group, a sulfonamide group, a carbamoyl group, a sulfamoyl group, etc. There may be any combination of these substituents and there may be up to 5 substituents on a phenyl ring and 7 for a napthyl group.

Particularly suitable substituents include an alkyl group, a hydroxyl group, an alkoxy group and a carbonamido group.

Examples of the masking couplers represented by the formula are shown below, but are by no means limited to these.

MC-1

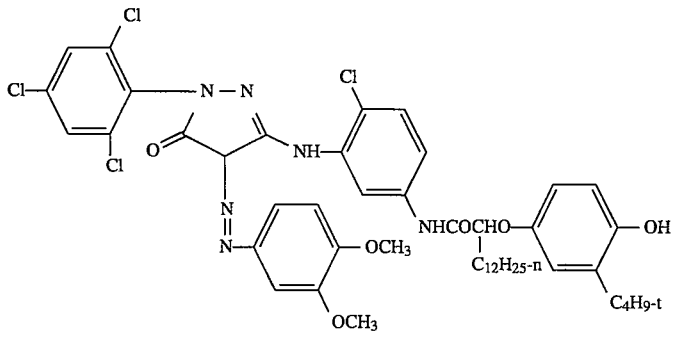

MC-2

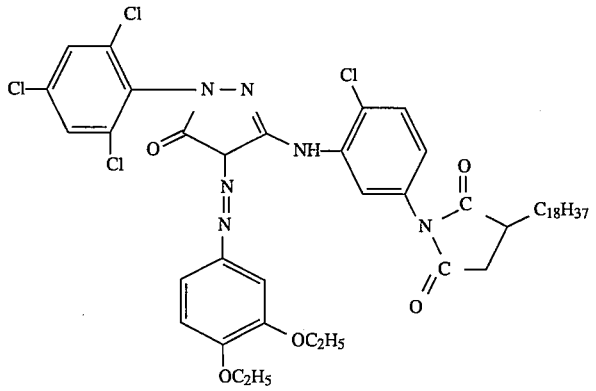

-continued
MC-3
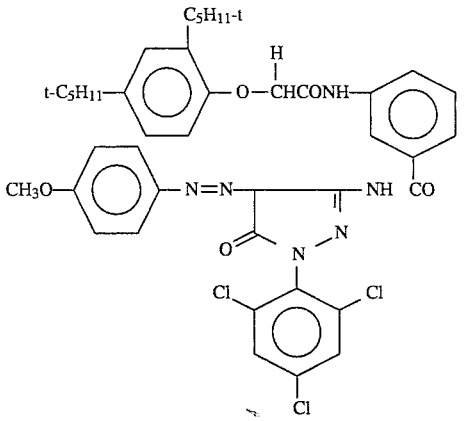
MC-4
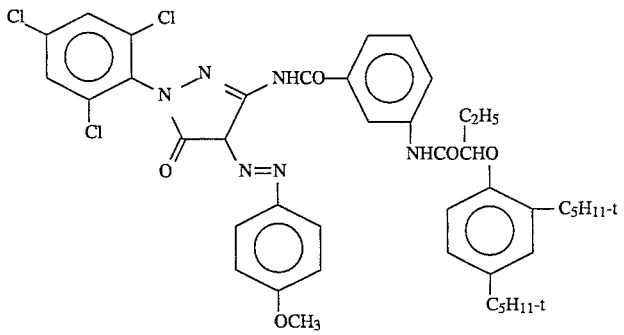
MC-5
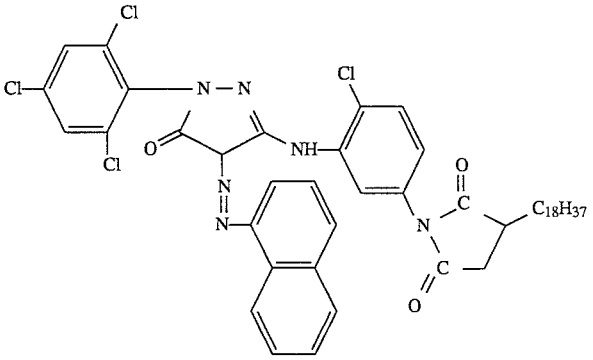
MC-6
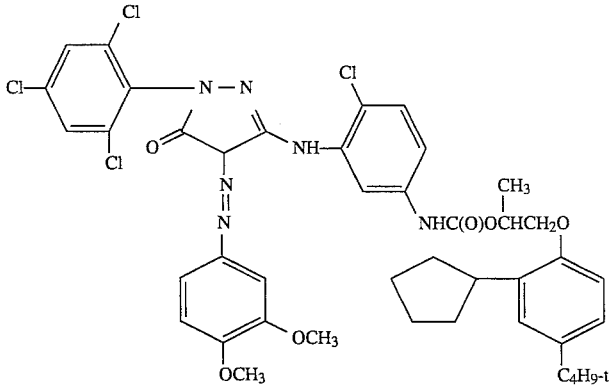

-continued
MC-7
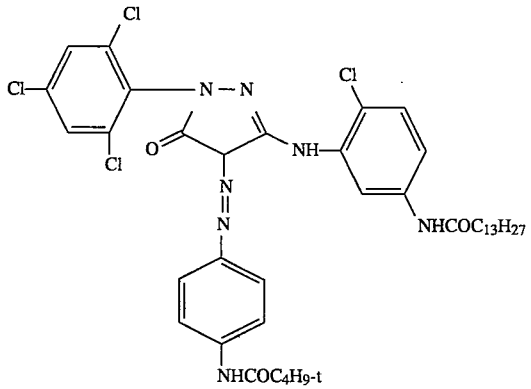
MC-8
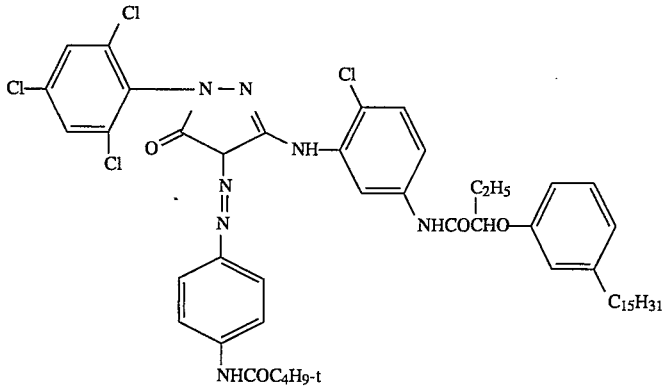
MC-9
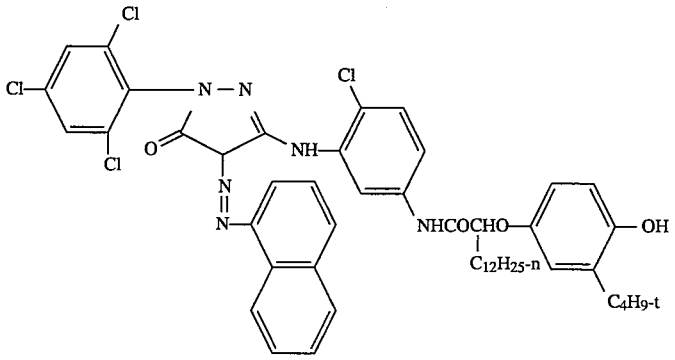
MC-10
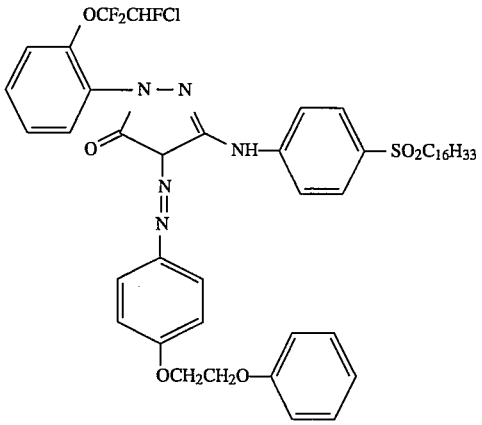

-continued
MC-11
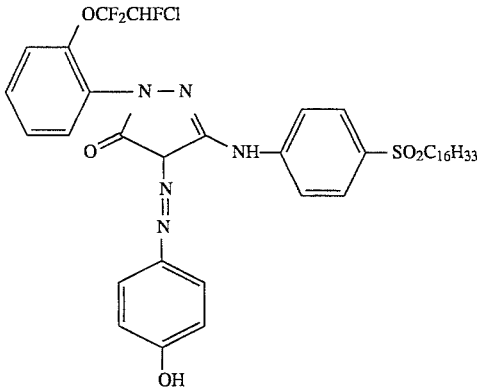
MC-12
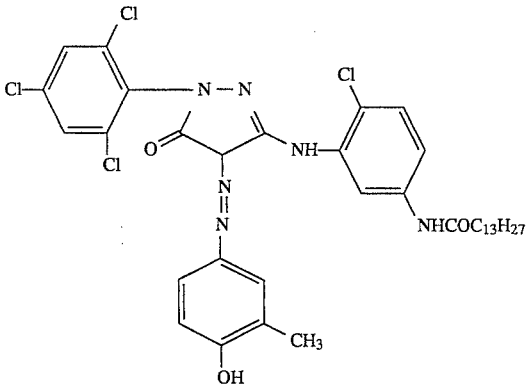
MC-13
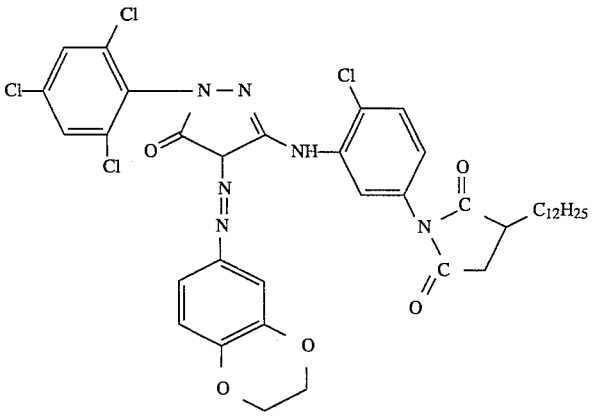
MC-14
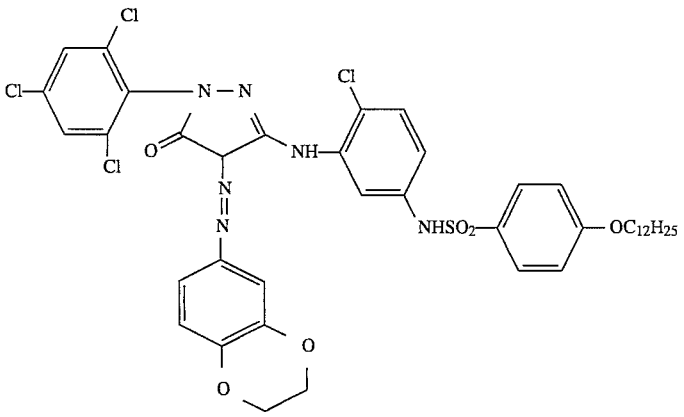

-continued
MC-15
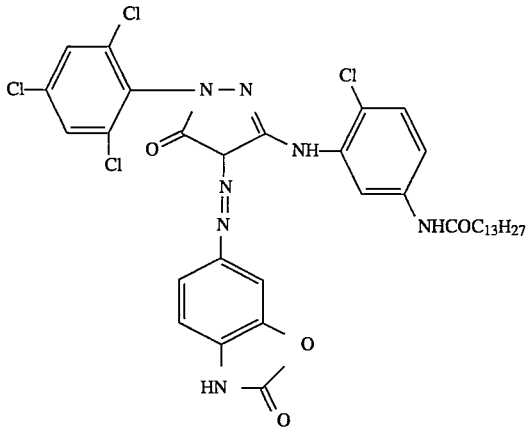
MC-16
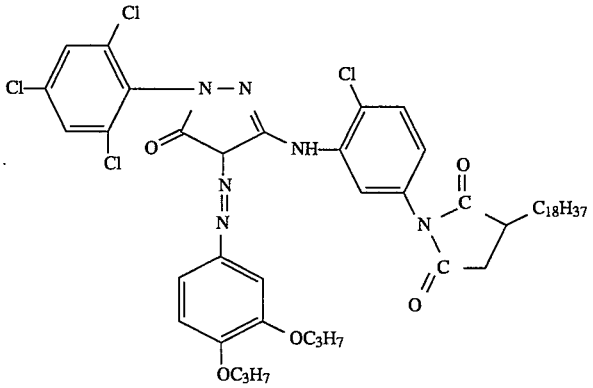
MC-17
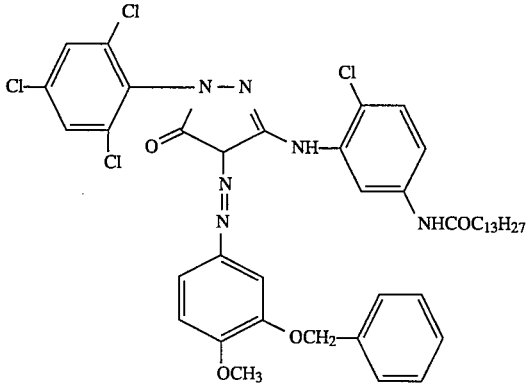
MC-18
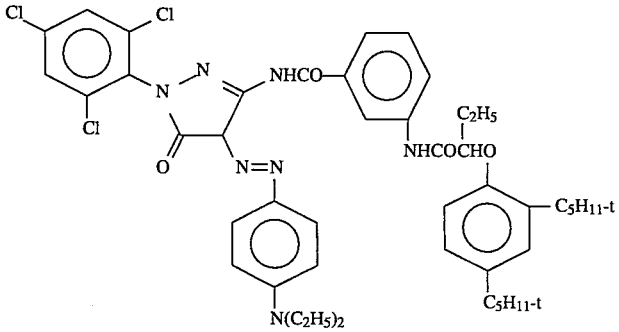

-continued
MC-19
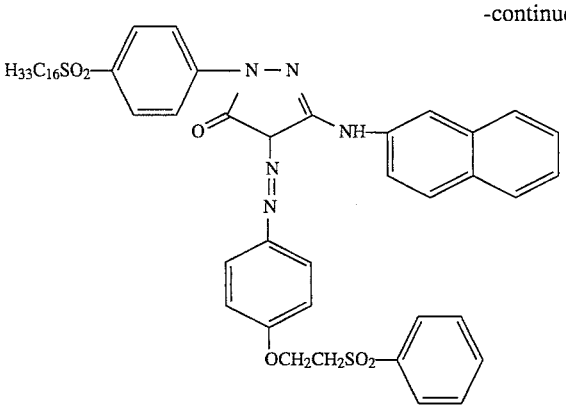
MC-20
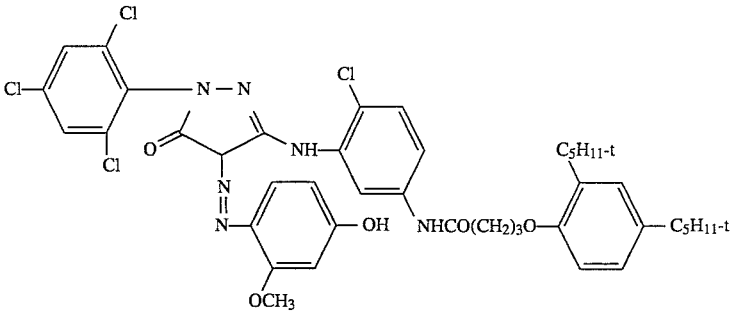
MC-21
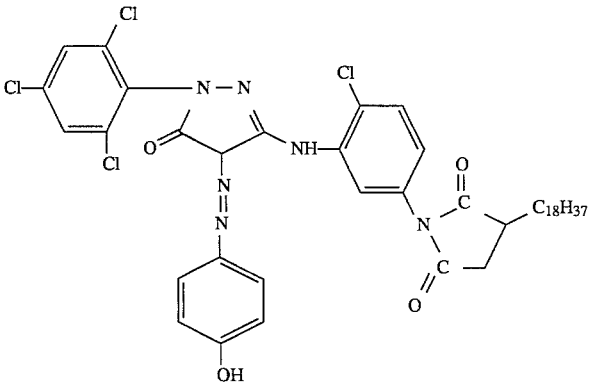
MC-22
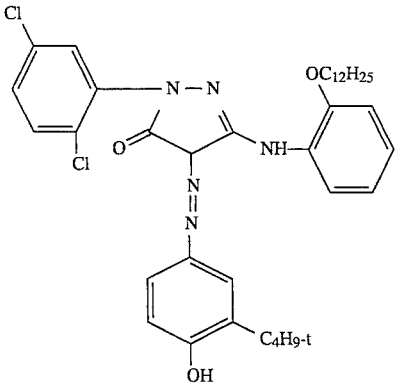

-continued
MC-23
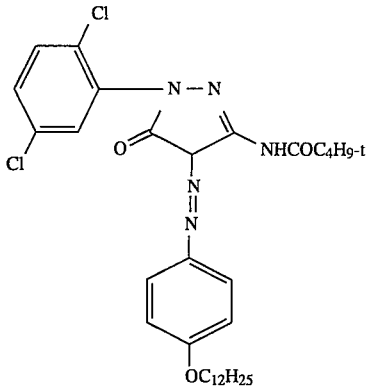
MC-24
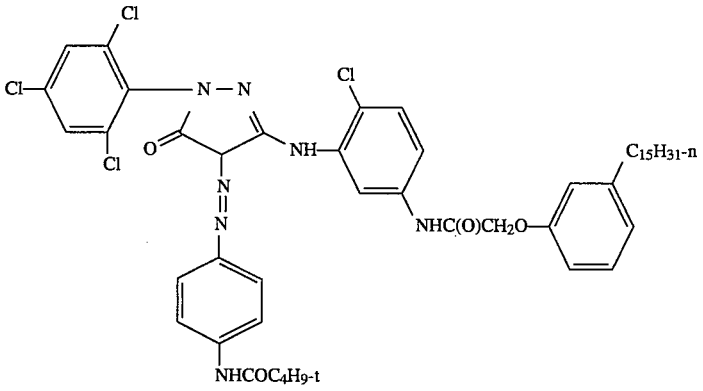
MC-25
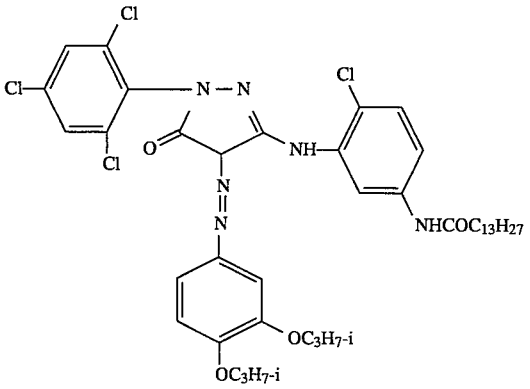
MC-26
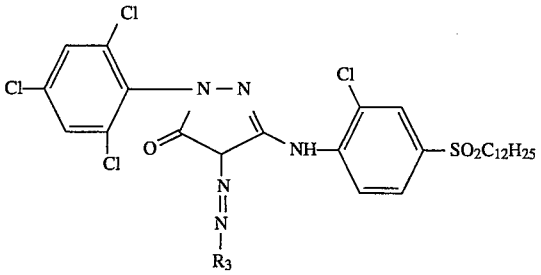

-continued
MC-27
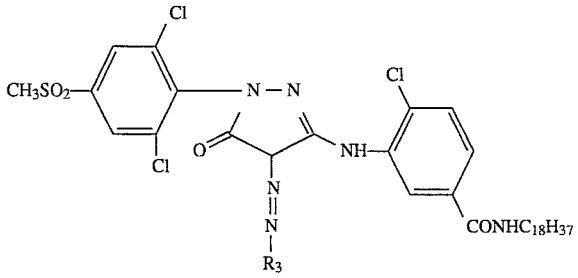
MC-28
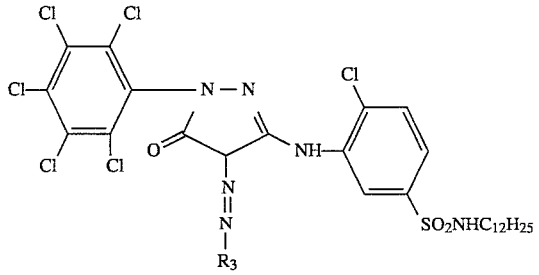
MC-29
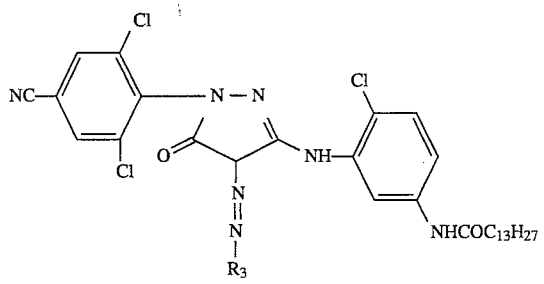
MC-30
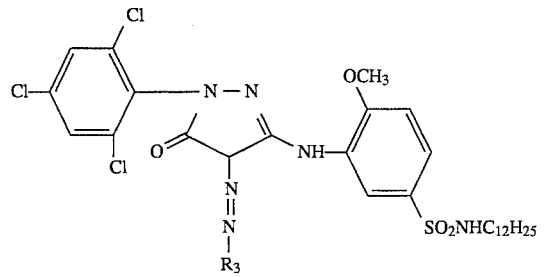
MC-31
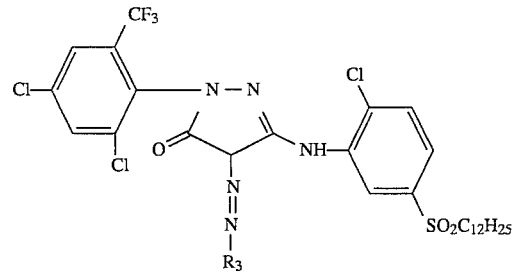
In the last six formulas, $R_3$ can be any one of the following, for example:
-continued
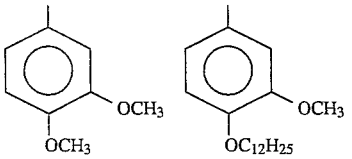

-continued

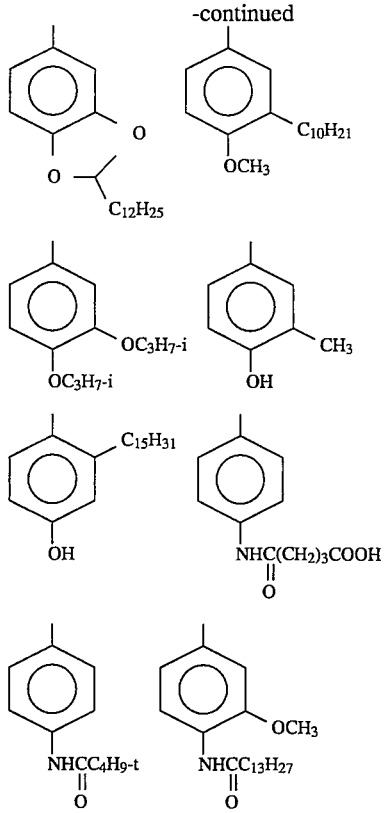

Synthesis of the masking couplers of the invention is well-known and may be generally carried out as more fully described in U.S. Pat. Nos. 2,763,552; 2,801,171; 2,852,370; 3,005,712; 3,519,429; 4,277,559; and Japanese Published Applications 49/123,625; 49/131,448; 52/42121; 52/102,723; 54/52,532; 58/1726; 59/214,853; 61/189,538; 62/50,830; 62/133,458; and 63/104,523.

Examples of substituent groups for the masking couplers or compounds discussed below include: an alkyl group which may be straight or branched, and which may be substituted, such as methyl, ethyl, n-propyl, n-butyl, t-butyl, trifluoromethyl, tridecyl or 3-(2,4-di-t-amylphenoxy)propyl; an alkoxy group, which may be substituted, such as methoxy or ethoxy; an alkylthio group, which may be substituted, such as methylthio or octylthio; an aryl group, an aryloxy group or an arylthio group, each of which may be substituted, such as phenyl, 4-t-butylphenyl, 2,4,6 -trimethylphenyl, phenoxy, 2-methylphenoxy, phenylthio or 2-butoxy-5-t-octylphenylthio; a heterocyclic group, a heterocyclic oxy group or a heterocyclic thio group, each of which may be substituted, and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2 -benzothiazolyl; cyano; an acyloxy group, which may be substituted, such as acetoxy or hexadecanoyloxy; a carbamoyloxy group, which may be substituted, such as N-phenylcarbamoyloxy or N-ethylcarbamoyloxy; a silyloxy group, which may be substituted, such as trimethylsilyloxy; a sulfonyloxy group, which may be substituted, such as dodecylsulfonyloxy; an acylamino or carbonamido group, which may be substituted, such as acetamido or benzamido; an anilino group, which may be substituted, such as phenylanilino or 2-chloroanilino; an ureido, group which may be substituted, such as phenylureido or methylureido; an imido group, which may be substituted, such as N-succinimido or 3 -benzylhydantoinyl; a sulfamoylamino group which may be substituted, such as N,N-dipropyl-sulfamoylamino or N-methyl-N-decylsulfamoylamino.

Additional examples of substituent groups include: a carbamoylamino group, which may be substituted, such as N-butylcarbamoylamino or N,N-dimethyl-carbamoylamino; an alkoxycarbonylamino group, which may be substituted, such as methoxycarbonylamino or tetradecyloxycarbonylamino; an aryloxycarbonylamino group, which may be substituted, such as phenoxycarbonylamino or 2,4-di-t-butylphenoxycarbonylamino; a sulfonamido group, which may be substituted, such as methanesulfonamido or hexadecanesulfonamido; a carbamoyl group, which may be substituted, such as N-ethylcarbamoyl or N,N-dibutylcarbamoyl; an acyl group, which may be substituted, such as acetyl or (2,4-di-t-amylphenoxy)acetyl; a sulfamoyl group, which may be substituted such as N-ethylsulfonyl or N,N-dipropylsulfamoyl; a sulfonyl group, which may be substituted, such as methanesulfonyl or octanesulfonyl; a sulfinyl group, which may be substituted, such as octanesulfinyl or dodecylsulfinyl; an alkoxycarbonyl group, which may be substituted, such as methoxycarbonyl or butyloxycarbonyl; an aryloxycarbonyl group, which may be substituted, such as phenyloxycarbonyl or 3-pentadecyloxycarbonyl; an alkenyl group, carbon atoms which may be substituted; a carboxyl group, which may be substituted; a sulfo group, which may be substituted; hydroxyl; an amino group, which may be substituted.

Substituents for the above substituted groups include halogen, an alkyl group, an aryl group, an aryloxy group, a heterocyclic or a heterocyclic oxy group, cyano, an alkoxy group, an acyloxy group, a carbamoyloxy group, a silyloxy group, a sulfonyloxy group, an acylamino group, an anilino group, a ureido group, an imido group, a sulfonylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group, an alkenyl group, a carboxyl group, a sulfo group, hydroxyl, an amino group or a carbonamido group.

Generally, the above groups and substituents thereof that contain an alkyl group typically include an alkyl group having 1 to 30 carbon atoms. The above groups and substituents thereof that contain an aryl group typically include an aryl group having 6 to 40 carbon atoms, and the above groups and substituents that contain an alkenyl group may include an alkenyl group having 2 to 6 carbon atoms.

Most preferred are chloride, and substituted or unsubstituted sulfamoyl, sulfone, carbamoyl, carboxylic acid, ester, trifluoromethyl, carbonamido, and cyano groups. If desired, these groups may contain a ballast and may be further substituted. One or more electron withdrawing groups may be present.

The second essential component of the invention is a ballasted aromatic nitro compound that has a reduction peak potential that is more positive than −1.3 V vs. SCE. The aromatic nitro compound may be any aromatic compound having a nitro substituent provided it meets the reduction peak potential requirement. Suitably the compound is a nitrophenyl compound. Any substituents as previously defined for the image couplers may be present with —$SO_2$NRR' and —CONRR' being most suitable. Suitable compounds may be represented by the following formula:

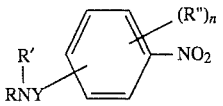

wherein Y is —$SO_2$— or —CO—; n is 0 to 4; R and R" are substituents and R' may be hydrogen or a substituent; all of such substituents selected so that the aromatic nitro compound has a reduction peak potential which is more positive than −1.3V. The aromatic nitro compound must be ballasted in order to insure that it remains dispersed in the coupler solvent to minimize interaction with the silver halide emulsion; otherwise its efficiency in reducing fogging will be limited. The requirements for ballast groups are well-known in the art. The ballast must lend sufficient hydrophobicity to the compound in order to prevent it from diffusing from the coupler solvent oil phase to the gel emulsion aqueous phase. Typically, a substituent of at least 6 or 8 carbon (preferrably alkyl) atoms is sufficient to accomplish the desired result although longer chains can be used especially if there are also polar substituents that might partially offset the effect of the ballast substituent.

In one suitable embodiment, the ballasted aromatic nitro compound is codispersed with the azopyrazolone masking coupler. In a codispersion, two or more components, possibly including an auxiliary solvent, are at the same time dispersed in the gelatin phase. One manner of preparing such a codispersion is the dissolution of both the ballasted aromatic nitro compound and the masking coupler in the same organic phase prior to dispersion into an aqueous gelatin solution.

Examples of substituent groups for the above include any of those as defined for the bicyclic azole and masking coupler. In addition to the nitro substituent, the aromatic nitro compound suitably contains as R and R' hydrogen and substituted or unsubstituted alkyl or aryl of up to 42 carbon atoms. R" is suitably halogen, nitro, cyano, carbonamido, carbamoyl, sulfonamido, sulfamoyl, sulfonyl, sulfinyl, acyl, or one of the substituents described for R, all containing up to 42 carbon atoms.

The reduction peak potential referred to herein is a test as described in *Journal of Chemical Education,* 1983, V.60, pp 290 and 702. The redox potential measurements are made vs. the standard calomel electrode (SCE). The redox potentials were measured at 25° C. utilizing acetonitrile solutions which were 0.001 molar in aromatic nitro compound and 0.1 molar in tetrabutylammoniumhexafluorophosphate as supporting electrolyte. Compounds that satisfy this requirement are far more efficient in controlling fog when azopyrazolone masking couplers are present in the photographic element.

It is believed that fog is caused by the generation of a phenyldinitrogen species from the masking coupler which diffuses to the silver emulsion and causes undesired nonimagewise silver reduction and fog. The ballasted aromatic nitro compound, being in close proximity to the masking coupler, is effective to prevent any phenyldinitrogen species which might be formed from the masking coupler from diffusing to the emulsion and there causing reduction of the photographic silver halide. Fog formation is thus reduced.

Examples of suitable ballasted aromatic nitro compounds of the invention and their corresponding reduction potential values are as follows:

| Compound | Redox Potential vs. S.C.E. (V) | Formula |
|---|---|---|
| N-1 | −1.04 | 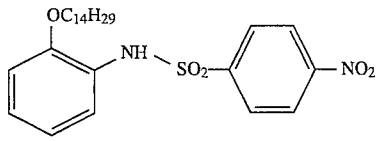 |
| N-2 | −0.91 | 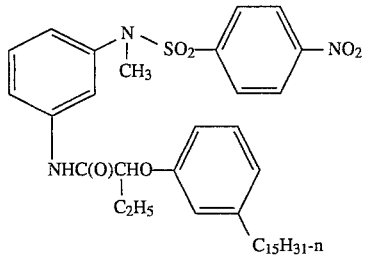 |
| N-3 | −1.05 | 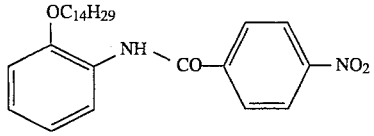 |
| N-4 | −0.89 | 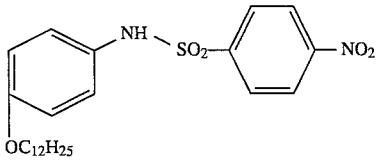 |
| N-5 | −1.02 | 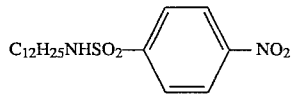 |
| N-6 | −1.00 | 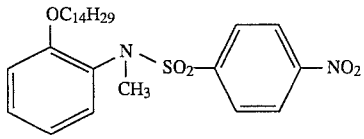 |
| N-7 | −0.74 | 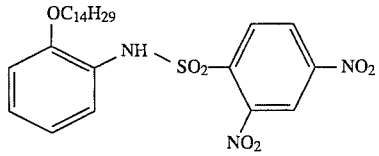 |
| N-8 | −1.14 | 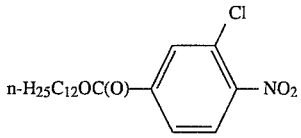 |

Although not essential, the photographic layer of the invention will typically have associated therewith a dye-forming coupler which may be any magenta dye-forming coupler. Couplers which form magenta dyes upon reaction-with oxidized color developing agent are described in such representative patents and publications as: U.S. Pat. Nos. 2,311,082; 2,343,703; 2,369,489; 2,600,788; 2,908,573; 3,062,653; 3,152,896; 3,451,820; 3,519,429; 3,615,502; 3,824,250; 4,076,533; 4,080,211; 4,215,195; 4,518,687; and 4,612,278; European Published Applications 177,765; 240,852; 284,239; 284,240; "Farbkuppler-eine Literaturubersicht," published in Agfa Mitteilungen, Band III, pp. 126–156 (1961), and Section VII D of *Research Disclosure*, Item 308119, December 1989. Preferably such couplers are pyrazolones or bicyclic azoles such as pyrazolotriazoles. The bicyclic azole compound contains at least two rings. Typically, the compound is a pyrazole or imidazole compound and may be represented by one of the formulas:

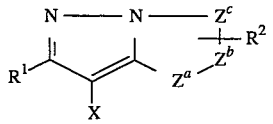

IA or

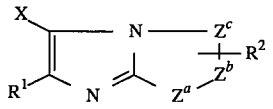

IB where the variables are as defined below.

One embodiment is a photographic element comprising a support bearing at least one photographic silver halide emulsion layer containing a dye-forming bicyclic azole coupler wherein the dye-forming coupler is represented by one of the formulas:

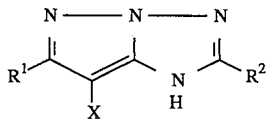

IIA

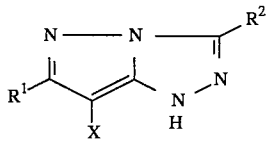

IIB

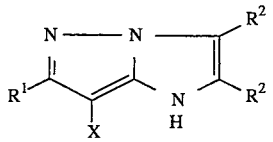

IIC

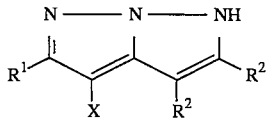

IID

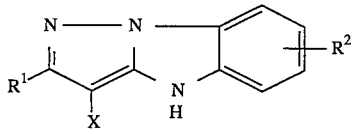

IIE

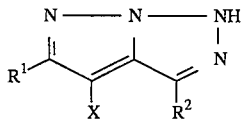

IIF

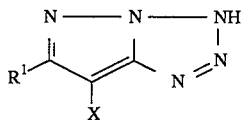

IIG

-continued

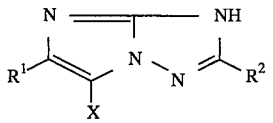

IIH wherein $R^1$ and each $R^2$ are independently hydrogen or substituents that do not adversely affect the coupling action of the coupler; X is hydrogen or a coupling-off group known in the photographic art; and $Z^a$, $Z^b$ and $Z^c$ are independently selected from the group consisting of a substituted or unsubstituted methine group, =N—, =C< or —NH—, provided that one of either the $Z^a$—$Z^b$ bond or the $Z^b$—$Z^c$ bond is a double bond and the other is a single bond, and when the $Z^b$—$Z^c$ bond is a carbon—carbon double bond, it may form part of an aromatic ring.

As used herein, the term substituent, both for $R^1$ and $R^2$ and elsewhere unless otherwise specifically stated, has a broad definition. The substituent may be, for example, halogen, such as chlorine, bromine or fluorine; nitro; hydroxyl; cyano; and —$CO_2H$ and its salts; and groups that may be further substituted, such as alkyl, including straight or branched chain alkyl, such as methyl, trifluoromethyl, ethyl, t-butyl, 3-(2,4-di-t-amylphenoxy)propyl, and tetradecyl; alkenyl, such as ethylene, 2-butene; alkoxy, such as methoxy, ethoxy, propoxy, butoxy, 2 -methoxyethoxy, sec-butoxy, hexyloxy, 2-ethylhexyloxy, tetradecyloxy, 2-(2,4-di-t-pentylphenoxy)ethoxy, and 2 -dodecyloxyethoxy; aryl such as phenyl, 4-t-butylphenyl, 2,4,6-trimethylphenyl, naphthyl; aryloxy, such as phenoxy, 2-methylphenoxy, α- or β-naphthyloxy, and 4 -tolyloxy; carbonamido, such as acetamido, benzamido, butyramido, tetradecanamido, α-(2,4-di-t-pentylphenoxy)acetamido, α-(2,4-di-t-pentylphenoxy)butyramido, α-(3-pentadecylphenoxy)hexanamido, α-(4-hydroxy-3-t-butylphenoxy)tetradecanamido, 2-oxo-pyrrolidin-1-yl, 2-oxo-5 -tetradecyl-pyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylcarbonylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5 -(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5 -di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, and hexadecylsulfonamido; sulfamoyl, such as N-methylsulfamoyl, N,N-dipropylsulfamoylamino, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4 -di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3 -pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4 -nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2 -ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4 -di-t-pentylphenoxy)ethylthio, phenylthio, 2-butoxy-5 -t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2 -benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 42 carbon atoms and typically less than 30 carbon atoms, but greater numbers are possible depending on the particular substituents selected. Moreover, as indicated, the substituents may themselves be suitably substituted with any of the above groups.

The bicyclic azole coupler contains in the coupling position, represented by X, either hydrogen or a coupling-off group.

Coupling-off groups are known to those skilled in the art. Such groups can determine the equivalency of the coupler, can modify the reactivity of the coupler, or can advantageously affect the layer in which the coupler is coated or other layers in the element by performing, after release from the coupler, such functions as development inhibition, development acceleration, bleach inhibition, bleach acceleration, color correction, and the like. Representative classes of coupling-off groups include halogen, particularly chlorine, bromine, or fluorine, alkoxy, aryloxy, heterocyclyloxy, heterocyclic, such as hydantoin and pyrazolo groups, sulfonyloxy, acyloxy, carbonamido, imido, acyl, heterocyclylimido, thiocyano, alkylthio, arylthio, heterocyclylthio, sulfonamido, phosphonyloxy and arylazo. They are described in, for example, U.S. Pat. Nos 2,355,169; 3,227,551; 3,432,521; 3,476,563; 3,617,291; 3,880,661; 4,052,212 and 4,134,766; and in U.K. patents and published application numbers 1,466,728; 1,531,927; 1,533,039; 2,006,755A 2,017,704A; and in EP 285,274.

Examples of specific coupling-off groups are Cl, F, Br, —SCN, —$OCH_3$, —$OC_6H_5$, —$OCH_2C(=O)NHCH_2CH_2OH$, —$OCH_2C(=O)NHCH_2CH_2OCH_3$, —$OCH_2C(=O)NHCH_2CH_2OC(=O)OCH_3$, —$NHSO_2CH_3$, —$OC(=O)C_6H_5$, —$NHC(=O)C_6H_5$, $OSO_2CH_3$, —$P(=O)(OC_2H_5)_2$, —$S(CH_2)_2CO_2H$,

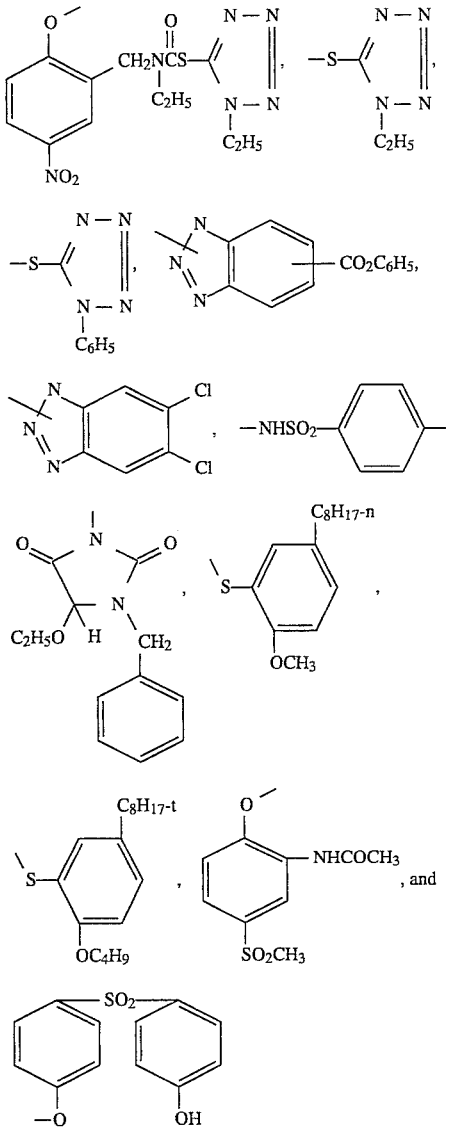

Suitably, the coupling-off group is H or halogen, and more specifically, H or Cl. Suitably, $R^1$ and $R^2$ together contain from 8 to 50 carbon atoms or more and typically 12 to 42 carbon atoms.

Generally, either $R^1$ or $R^2$ contains a ballast group where the ballast group is an organic radical of such size and configuration as to confer on the coupler molecule sufficient bulk to render the coupler substantially non-diffusible from the layer in which it is coated in a photographic element. Thus, the combination of groups $R^1$ and $R^2$ from the formula are chosen to meet this criteria as can be determined by one skilled in the art.

Typical pyrazolo-[3,2-c]-1,2,4-triazole magenta image dye-forming couplers within the described structure are disclosed in, for example, U.S. Pat. Nos. 4,443,536; 4,777,121; 4,808,502; 4,835,094; 4,960,685; and 5,019,489; and European Patents 284,240 and 285,274.

Typical Pyrazolo-[1,5-b]-1,2,4-triazole couplers are described in, for example, U.S. Pat. Nos. 4,540,654; 4,659,652; 4,774,172; 4,822,730; and 4,925,781; Japanese Published Patent Application No. 61-147254; and European Patents 119,860; 226,849; 234,428; and 294,785.

Typical bicyclic imidazole compounds are exemplified in PCT patent publication WO 92/12464.
Specific examples of couplers useful in the element of the invention are
M-1
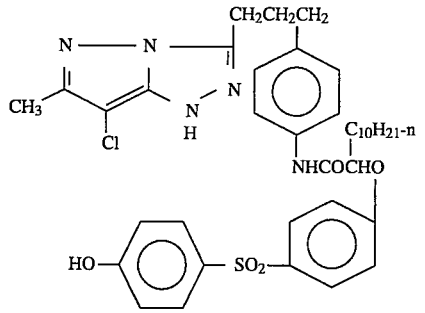
M-2
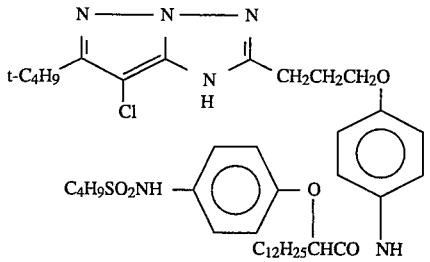
M-3
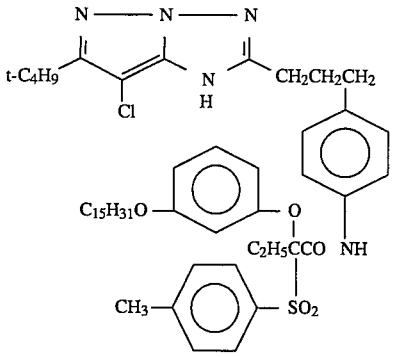
M-4
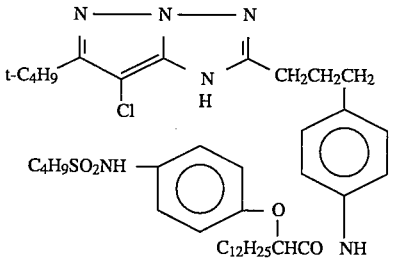
M-5
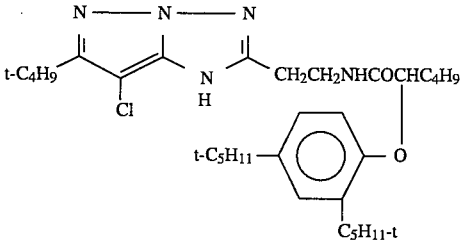

-continued
M-6
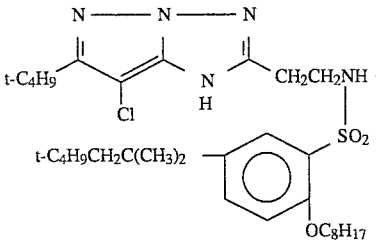
M-7
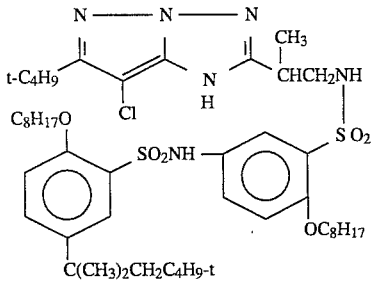
M-8
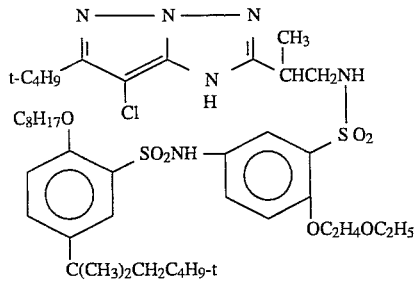
M-9
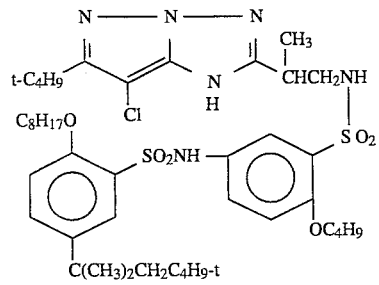
M-10
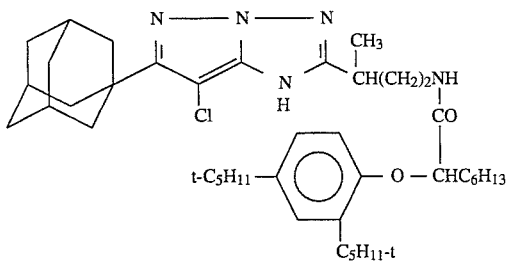
M-11
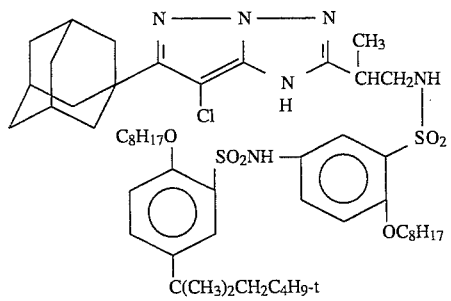

-continued
M-12
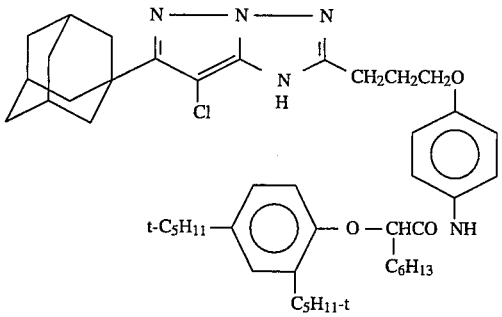
M-13
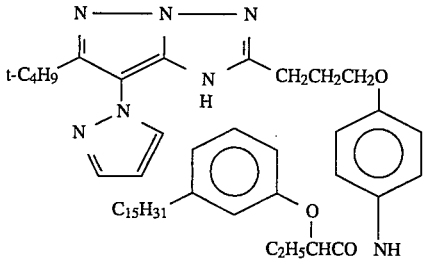
M-14
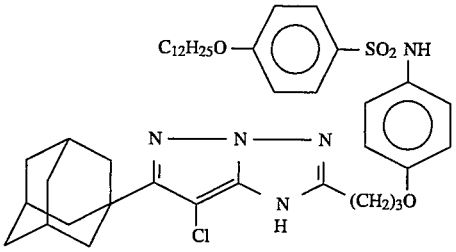
M-15
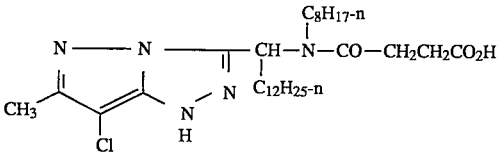
M-16
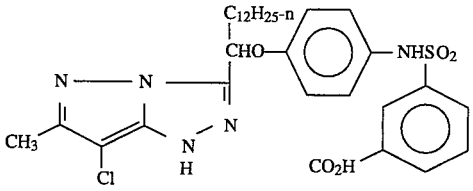
M-17
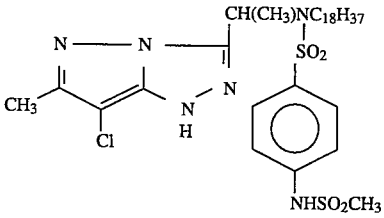

-continued
M-18
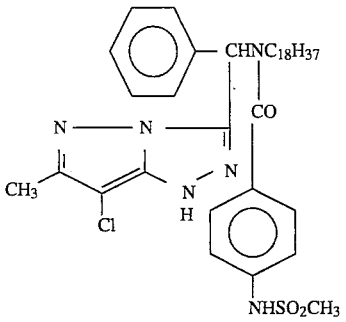
M-19
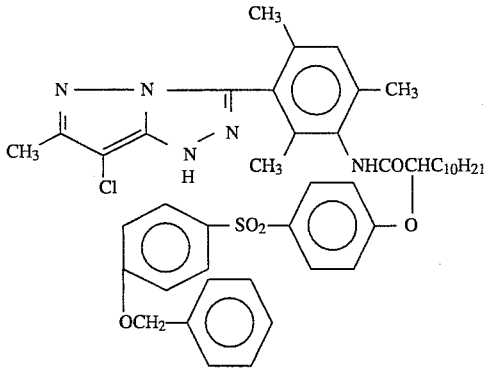
M-20
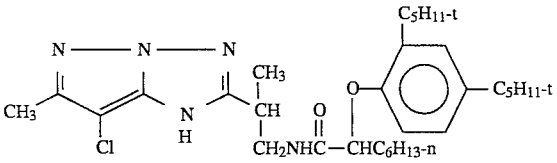
M-21
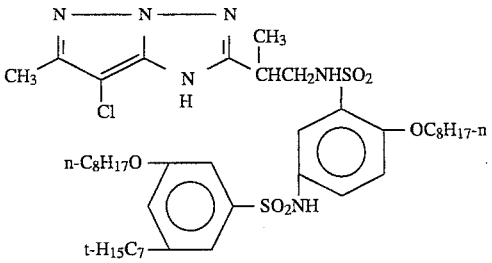
M-22
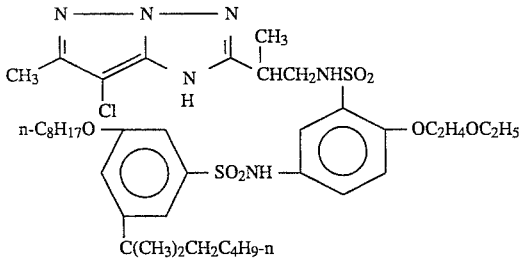
M-23
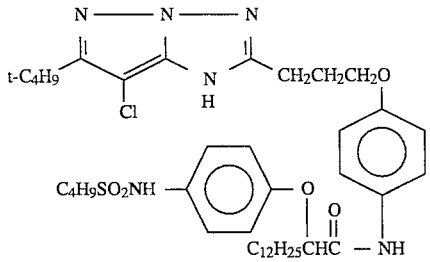

-continued
M-24
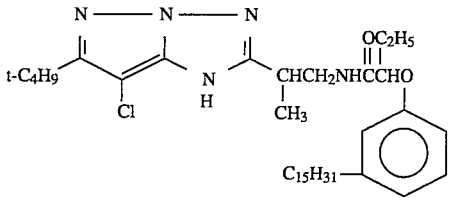
M-25
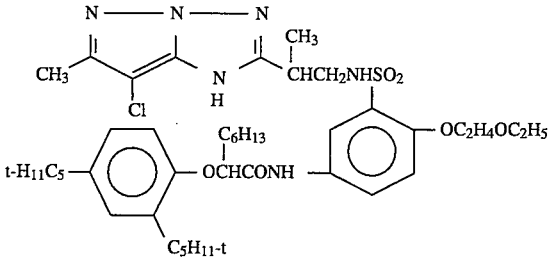
M-26
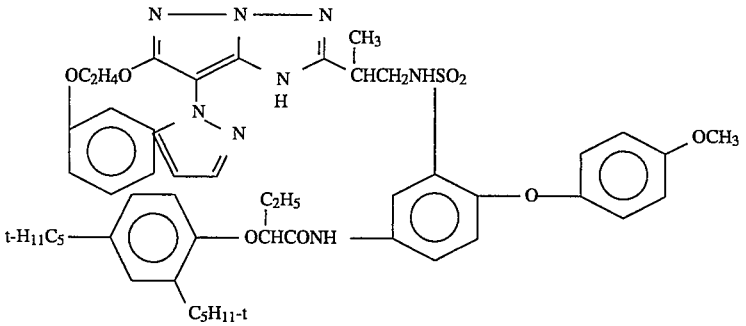
M-27
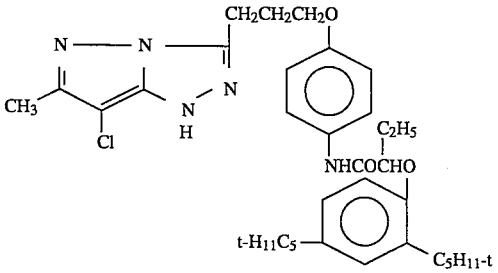
M-28
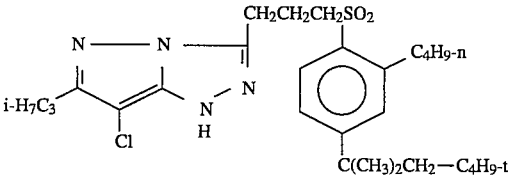
M-29
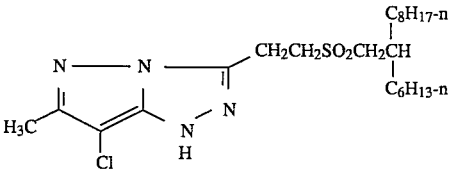
M-30
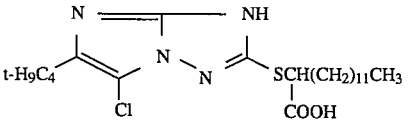
The pyrazolone image coupler may be represented by the formula:

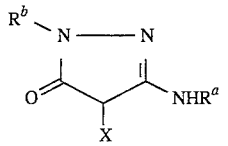

In the formula, $R^a$ may be an aryl or acyl group and $R^b$ may be an aryl group. As an aryl group, $R^a$ and $R^b$ are typically naphthyl or phenyl and most suitably, phenyl, substituted or unsubstituted, and X is hydrogen or a coupling-off group as defined for the bicyclic azole coupler. An example of a suitable phenyl group has the formula:

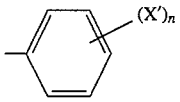

wherein n is an integer from 0 to 5 and each X' independently represents any of the groups as described for $R^1$ and $R^2$ as defined for the bicyclic azole coupler. $R^a$ may also be

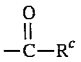

wherein $R^c$ is a substituted or unsubstituted alkyl or aryl group. The alkyl group is preferably a straight-chain or branched-chain alkyl group having from 1 to 32 carbon atoms, which may, for example, have a substituent such as halogen, alkoxy, phenoxy, nitro, carbonyl, cyano, or the like. The aryl group is preferably one having one or more substituents such as alkyl, alkoxy, phenoxy, acylamino, sulfonamido, carbonylalkoxy, carbonylaryl, oxycarbonyl, carbamoyl, sulfamoyl, halogen, nitro, cyano, succinimide, and the like.

Particular examples of $R^b$ are phenyl, 2,4,6 -trichlorophenyl, pentachlorophenyl, 2,4,6 -trimethylphenyl, pentafluorophenyl, 2-chloro-4,6 -dimethylphenyl, 2,6-dichloro-4-methylphenyl, 2,4 -dichloro-6-methylphenyl, 2,4-dichloro-6-methoxyphenyl, 2,6-dichloro-4-methoxyphenyl, and 2,6-dichloro-4-α-(2,4-di-t-amylphenoxy)acetamido}phenyl.

Examples of suitable parent groups to which X can be attached are:

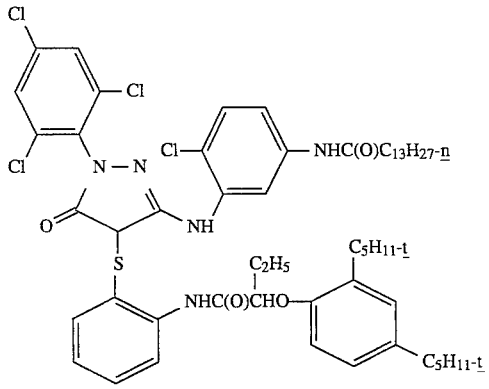

P-1

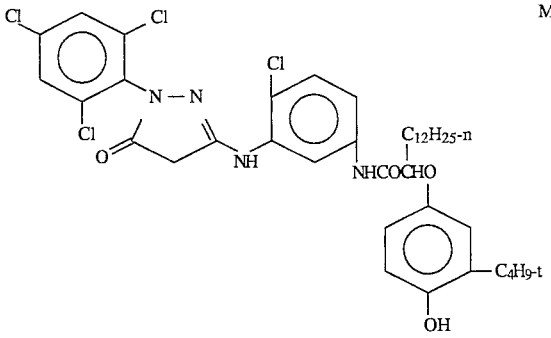

MP-1

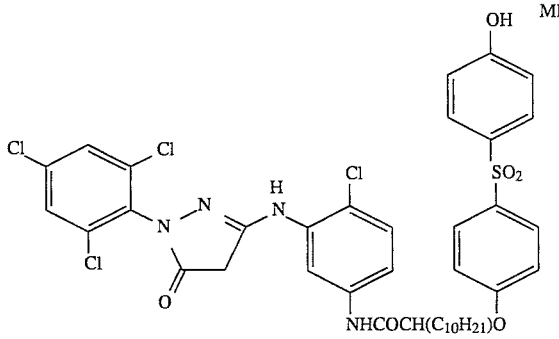

MP-2

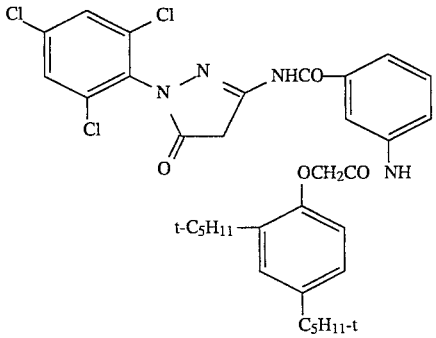

MP-3

Examples of magenta dye-forming pyrazolone couplers are:

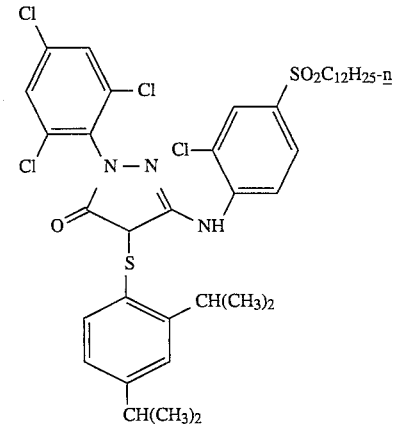

P-2

-continued
P-3
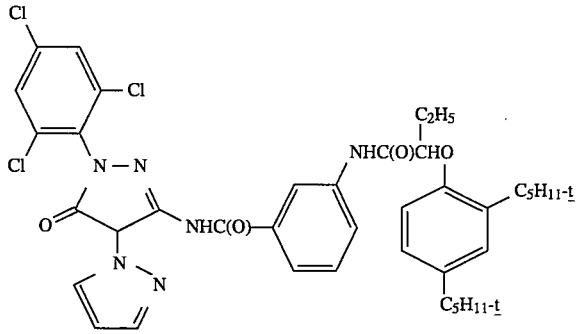
P-4
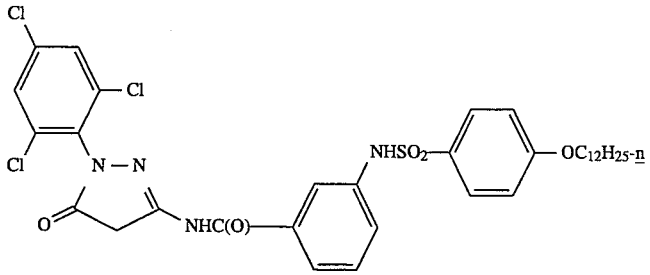
P-5
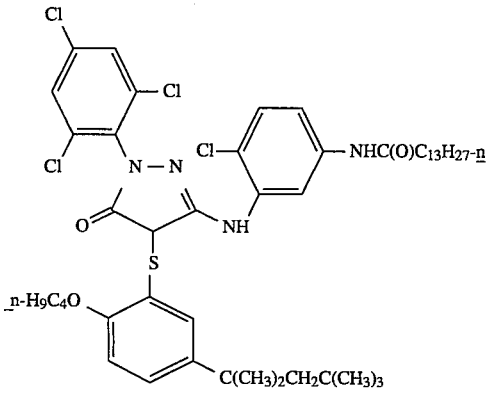
P-6
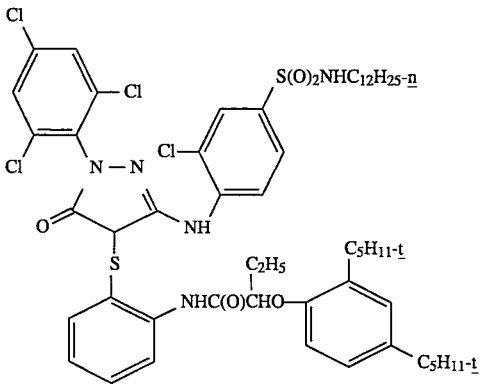
P-7
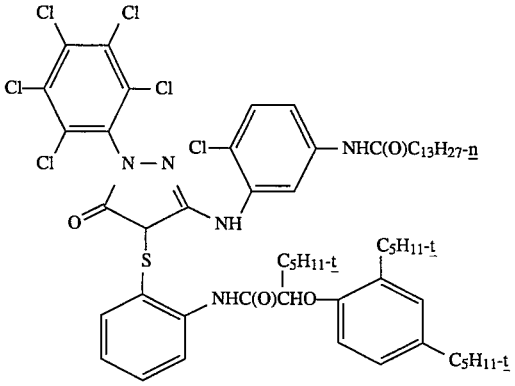
P-8
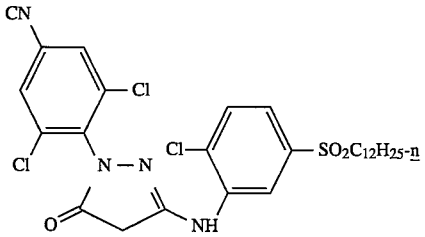

-continued

P-9

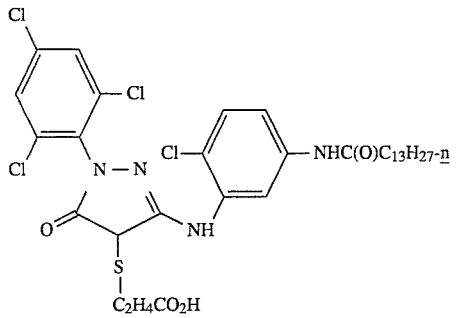

P-10

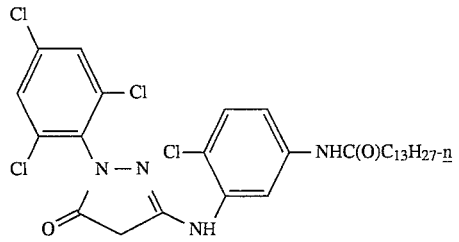

Further examples of suitable $R^a$ and $R^b$ groups may be found in European Patent publication 467,327 and in U.S. Pat. No. 4,600,688.

Examples of substituent groups for the above include any of those as defined for the bicyclic azole and masking coupler.

The materials of this invention can be used in any of the ways and in any of the combinations in which such materials are used in the photographic art. Typically, they may be incorporated in a layer containing a silver halide emulsion and the emulsion layer coated on a support to form part of a photographic element.

The photographic elements can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one greensensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a masking coupler of this invention. The element can contain additional layers, such as filter layers, interlayers, overcoat layers, subbing layers, and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido)ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

The materials described herein may be used in combination with other types of couplers such as enamines, 3-acylamino- or 3-anilino-5-pyrazolones and heterocyclic couplers (e.g. pyrazoloazoles) such as those described in EP 285,274; U.S. Pat. No. 4,540,654; EP 119,860, or with other 5-pyrazolone couplers containing different ballasts or coupling-off groups such as those described in U.S. Pat. Nos. 4,301,235; 4,853,319 and 4,351,897. The coupler may also be used in association with yellow or cyan colored couplers (e.g. to adjust levels of interlayer correction) and with other masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

For example, the materials of the invention may be included in a magenta layer or may be added to one or more of the other layers in a color negative photographic element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3 -((2-(4-ethoxy-2,5-dioxo-3-(phenylmethyl)-1 -imidazolidinyl)-3-(4-methoxyphenyl)-1,3 -dioxopropyl)amino)-, dodecyl ester and a slow yellow layer containing the same compound together with "Coupler 2": Propanoic acid, 2 -[[5-[[4-[2-[[[2,4 -bis(1,1-dimethylpropyl)phenoxy]acetyl]amino]-5 -[(2,2,3,3,4,4,4-heptafluoro-1-oxobutyl)amino]-4 -hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl)ethyl-(3-chloro-4-((3-(2-chloro-4-((1-tridecanoylethoxy)carbonyl)anilino)- 3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4 -bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4 -bis(1,1-dimethylpropyl)phenoxy)-1-oxobutyl)amino)-N-(4',5'-dihydro-5'-oxo-1'-(2,4,6-trichlorophenyl) (1,4' -bi-1H-pyrazol)-3'-yl)-, "Coupler 6": Carbamic acid, (6 -(((3-(dodecyloxy)propyl)amino)carbonyl)-5-hydroxy-1 -naphthalenyl)-, 2-methylpropyl ester , "Coupler 7": Acetic acid, ((2-((3-(((3-(dodecyloxy)propyl)amino)carbonyl)- 4-hydroxy-8-(((2-methylpropoxy) carbonyl)amino)-1-naphthalenyl)oxy)ethyl)thio)-, and "Coupler 8" Benzamide, 3-((2-(2,4-bis(1,1-dimethylpropyl)phenoxy)-1-oxobutyl)amino)-N-(4,5-dihydro-4-((4 -methoxyphenyl)azo)-5-oxo-1-(2,4,6-trichlorophenyl)-1H-pyrazol-3-yl)-; a mid-magenta layer and a slow magenta layer each containing "Coupler 9": 2-Propenoic acid , butyl ester, styrene, 2:1:1 polymer with (N-[1-(2,4,6 -trichlorophenyl)-4,5-dihydro-5-oxo-1H-pyrazol-3-yl]-2 -methyl-2-propenamide)$_2$ and "Coupler 10": Tetradecanamide, N-(4-chloro-3-((4-((4-((2,2-dimethyl-1-oxopropyl)amino)phenyl)azo)-4,5-dihydro-5-oxo-1 -(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1 -dimethylpropyl)phenoxy)propyl)amino)carbonyl)-4 -hydroxy-1-naphthalenyl)oxy)ethoxy)phenyl)azo)-4 -hydroxy-, disodium salt; and a slow cyan layer containing Couplers 2 and 6;

(7) an undercoat layer containing Coupler 8; and (8) an antihalation layer.

The materials may also be used in association with materials that accelerate or otherwise modify the processing steps, e.g. of bleaching or fixing, to improve the quality of the image. Bleach accelerators described in EP 193,389; EP 301,477; U.S. Pat. Nos. 4,163,669; 4,865,956; and 4,923,784 are particularly useful. Also contemplated is use of the coupler in association with nucleating agents, development accelerators or their precursors (UK Patent 2,097,140; U.K. Patent 2,131,188); electron transfer agents (U.S. Pat. Nos. 4,859,578; 4,912,025); antifogging and anticolor-mixing agents such as derivatives of hydroquinones, aminophenols, amines, gallic acid; catechol; ascorbic acid; hydrazides; sulfonamidophenols; and non-color-forming couplers.

The materials of the invention may also be used in combination with filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, they may be blocked or coated in protected form as described, for example, in japanese Application 61/258,249 or U.S. Pat. No. 5,019,492.

They may further be used in combination with image-modifying compounds such as "Developer Inhibitor-Releasing" compounds (DIR's). DIR's useful in conjunction with the materials of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering, Vol.* 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

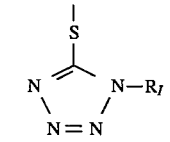

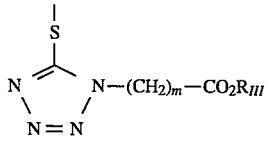

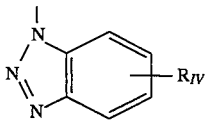

-continued

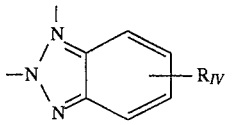

wherein $R_I$ is selected from the group consisting of straight and branched alkyls of from 1 to about 8 carbon atoms, benzyl and phenyl groups and said groups containing at least one alkoxy substituent; $R_{II}$ is selected from $R_I$ and —$SR_I$; $R_{III}$ is a straight or branched alkyl group of from 1 to about 5 carbon atoms and m is from 1 to 3; and RiV is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

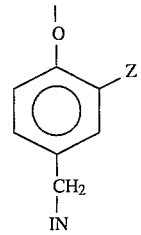

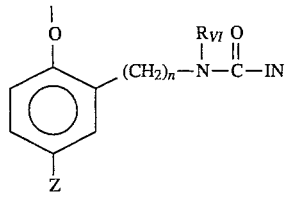

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

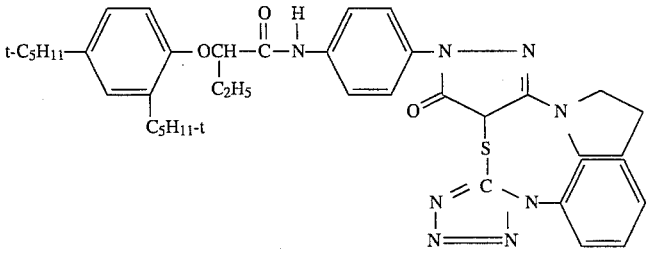

D2

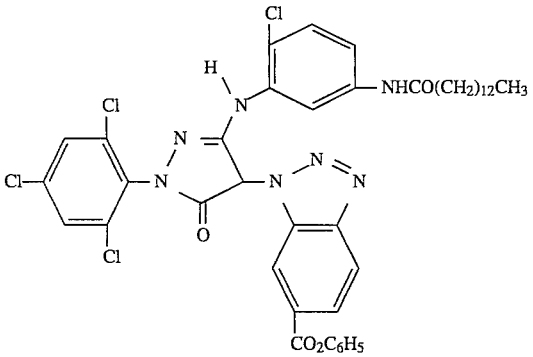

D3

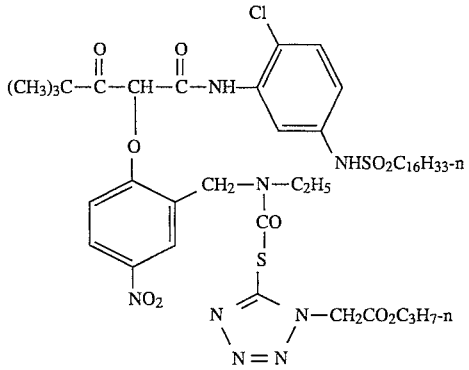

-continued

D4

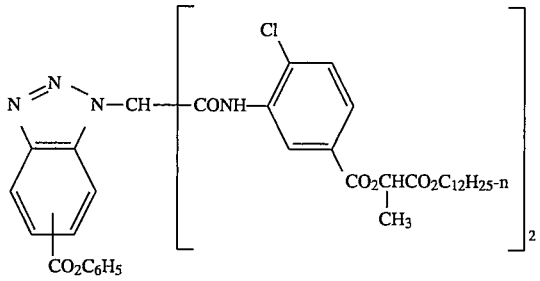

D5

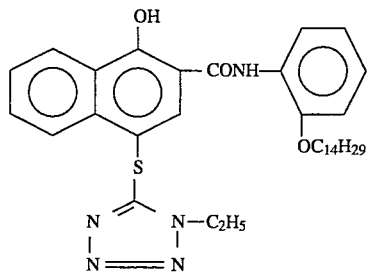

D6

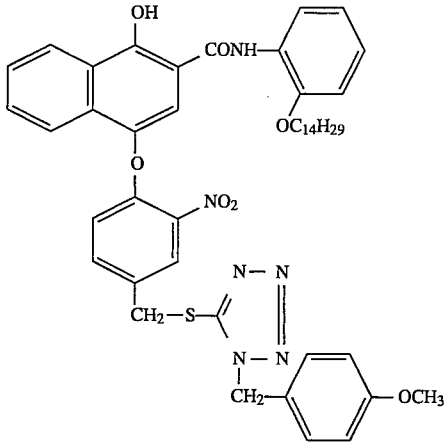

D7

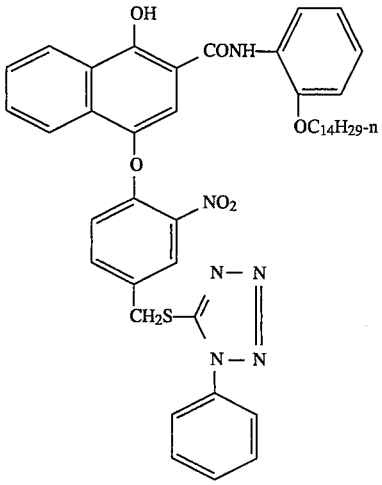

D8

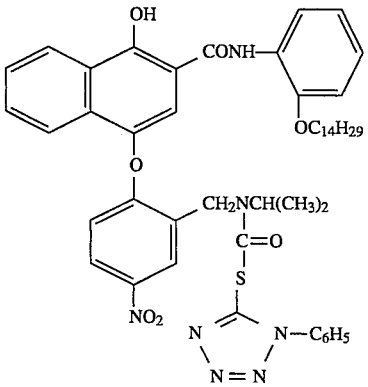

D9

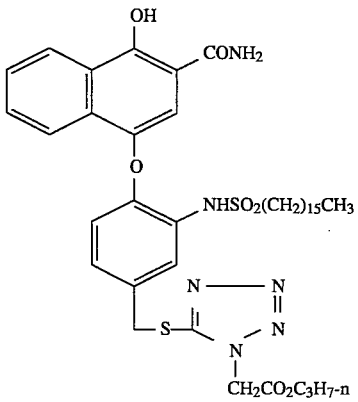

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or internal latent images predominantly in the interior of the silver halide grains. The emulsions can be negative-working emulsions, such as surface-sensitive emulsions or unfogged internal latent image-forming emulsions.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in, for example, the British Journal of Photography Annual of 1988, pages 191–198.

Development is followed by the conventional steps of bleaching, fixing, or bleach-fixing, to remove silver or silver halide, washing, and drying.

The image and masking couplers can be prepared using any of the methods well-known in the art as described, for example, in Section VII of Research Disclosure, and for example in the following patents: European Patent 285,274; PCT published application W092/12,464; U.S. Pat. Nos. 2,852,370; 3,005,712; 3,725,067; 4,277,559; and 4,540,654.

PHOTOGRAPHIC EXAMPLES AND COMPARISONS

Example 1

The benefits of the invention can be demonstrated in the following examples. A single layer photographic element was prepared by coating a cellulose acetate-butyrate film support with a photosensitive layer containing a green-sensitive silver bromoidodide emulsion at 1.61 g/m$^2$, gelatin at 3.77 g/m$^2$, 0.18 g/m$^2$ of 4-hydroxy-6-methyl-1,3,3a,7-tetraazaindene antifoggant, 0.43 g/m$^2$ of image coupler M-15 and 0.11 g/m$^2$ of masking coupler MC-1 dispersed in an equal weight of tritolylphosphate. The benefits of the invention were seen when 0.11 g/m$^2$ of the ballasted aromatic compounds of the invention was codispersed with the masking coupler. The photosensitive layer was overcoated with a layer containing gelatin at 2.69 g/m$^2$ and was hardened with bis-sulfonyl methyl ether hardener at 1.75 percent based on total gel.

To demonstrate the reduced fogging obtained with the coatings of the invention, the coatings were exposed through a stepped density test object and processed at 37.8° C. employing the following color developing solution, then stopped with a low pH bath, bleached, fixed, washed, and dried to produce stepped colored images.

Color Developing Solution 34.3 g potassium carbonate, anhydrous;
2.32 g potassium bicarbonate;
0.38 g sodium sulfite, anhydrous;
2.78 g sodium metabisulfite;
1.20 mg potassium iodide;
1.31 g sodium bromide;
8.43 g diethylenetriaminepentaacetic acid pentasodium salt (40% solution);
2.41 g hydroxylamine sulfate;
4.52 g. KODAK Color Developing Agent CD-4; and
water to make 1 L, 10.0 pH.

The benefit of the invention is shown by the effect of the ballasted aromatic nitro compound on the amount of developed silver and the amount of dye generated at minimum exposure during extended processing times.

TABLE I

| Type I-(Invention) C-(Comparison) | Addenda | Silver Developed at Minimum Exposure at Varied Tunes of Development (mg/m$^2$) 3'15" | 4'15" | 6' |
|---|---|---|---|---|
| C | None | 40 (±8) | 83 (±5) | 193 (±12) |
| I | N-1 | 28 (±15) | 65 (±5) | 132 (±5) |
| I | N-2 | 45 (±11) | 59 (±3) | 144 (±9) |

TABLE II

| Type I-(Invention) C-(Comparison) | Addenda | Green Density at Minimum Exposure at Varied Times of Development (Status M) 3'15" | 4'15" | 6' |
|---|---|---|---|---|
| C | None | 0.45 | 0.79 | 1.59 |
| I | N-1 | 0.38 | 0.61 | 1.25 |
| I | N-2 | 0.36 | 0.62 | 1.27 |

As can be seen from the above data, addition of the ballasted aromatic nitro compounds lessened the development silver and green density at minimum exposure with longer processing times. Examination of the silver and dye scales at 3'15" development shows the ballasted aromatic nitro compounds had no significant adverse effect on the photographic behavior of the layer at standard development time.

Example 2

Preparation of Comparative Example 1

A photographic element was produced by coating the following layers on a cellulose triacetate film support (coverage are in grams per meter squared);

Layer 1 (Antihalation layer): black collodial silver sol at 0.322 and gelatin at 2.69.

Layer 2 (Slow cyan layer): a blend of two red sensitized (both with a mixture of RSD-1 and RSD-2) silver iodobromide emulsions: (i) a medium sized tabular grain emulsion (3 mole % I) at 1.48 and (ii) a smaller cubic emulsion (3.5 mole % I) at 1.08; gelatin at 3.01; cyan dye-forming coupler C-1 at 0.87; DIR coupler DIR-1 at 0.06; bleach accelerator releasing coupler B-1 at 0.01 and anti-foggant 4-hydroxy-6 -methyl-1,3,3a,7-tetraazaindene at 0.036.

Layer 3 (Fast cyan layer): a red-sensitized (same as above) tabular silver iodobromide emulsion (6 mole % I) at 0.81; cyan coupler C-1 at 0.17; DIR-1 at 0.065 and DIR-2 at 0.032; gelatin at 1.68 and anti-foggant 4 -hydroxy-6-methyl-1,3,3a,7-tetraazaindene at 0.036.

Layer 4 (Interlayer): oxidized developer scavenger OxDS-1 at 0.054 and gelatin at 1.29.

Layer 5 (Slow magenta layer): a blend of two green sensitized (both with a mixture of GSD-1 and GSD- 2)silver iodobromide emulsions: (i) 3 mole % iodide at 0.56 and (ii) 1.5 mole % iodide at 0.17; magenta dye forming coupler PA-1 (dispersed at ½ its weight in tricresylphosphate) at 0.34; DIR-3 at 0.006; masking coupler MC-1 at 0.04; gelatin at 1.63 and anti-foggant 4-hydroxy-6-methyl-1,3,3a,7-tetraazaindene at 0.036.

Layer 6 (Fast magenta layer); a blend of two green sensitized (same as above) 3 mole % iodide tabular silver iodobromide emulsions at a total of 1.24; PA-1 (dispersed as above) at 0.17; MC-1 at 0.016; DIR-3 at 0.038; gelatin at 1.40 and anti-foggant 4-hydroxy-6 -methyl-1,3,3a,7-tetraazaindene at 0.036.

Layer 7 (Yellow filter layer): gelatin at 0.86; Carey-Lea silver at 0.043 and OxDS-1 at 0.054.

Layer 8 (Slow yellow layer): a blend of two blue sensitized (both with YSD-1) tabular silver iodobromide emulsions (3 mole % I) at a total of 0.47; yellow dye forming coupler Y-1 at 0.55; DIR-4 at 0.11 and gelatin at 1.73.

Layer 9 (Fast yellow layer): a blue sensitized (with YSD-1) tabular silver iodobromide emulsion (3 mole % I) at 0.47; Y-1 at 0.22; DIR-4 at 0.04 and gelatin at 0.81.

Layer 10 (Protective overcoat and UV filter layer): gelatin at 1.24; silver bromide Lippman emulsion at 0.23; UV-1 and UV-2 (1:1 ratio) at a total of 0.023 and bis(vinylsulfonyl-)methane hardener at 1.8% of total gelatin weight.

Surfactants, coating aids, emulsion addenda, matte and tinting dyes were added to the appropriate layers as is common in the art.

The structures of the compounds used in the multilayer examples are:

C-1:

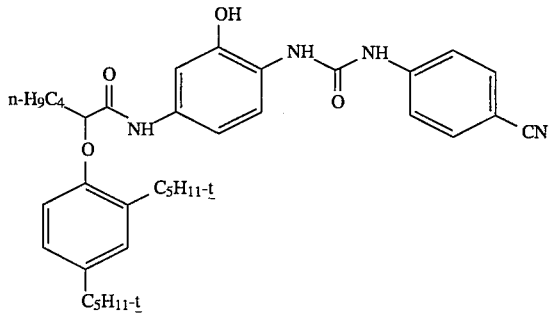

B-1:

-continued

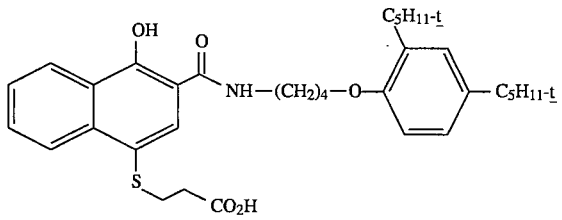

DIR-1:

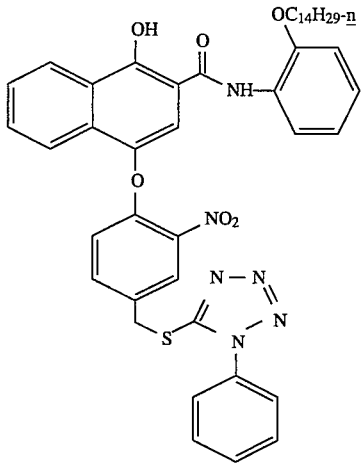

DIR-2:

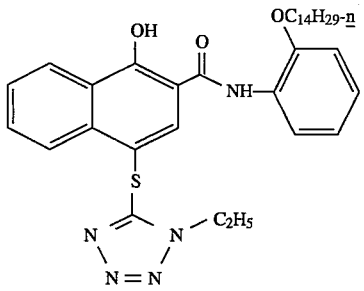

DIR-3:

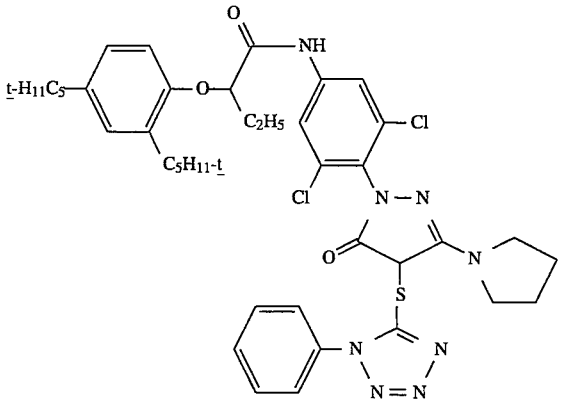

Y-1:

-continued
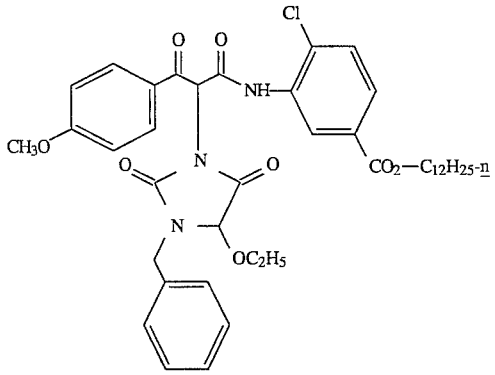
DIR-4:
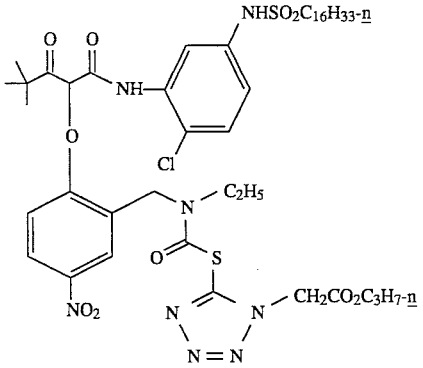
OxDS-1:
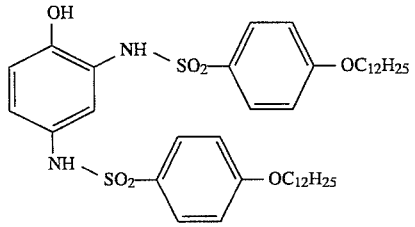
RSD-1:
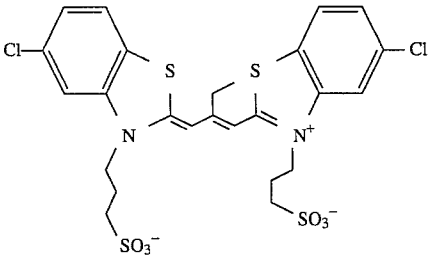
RSD-2:
-continued
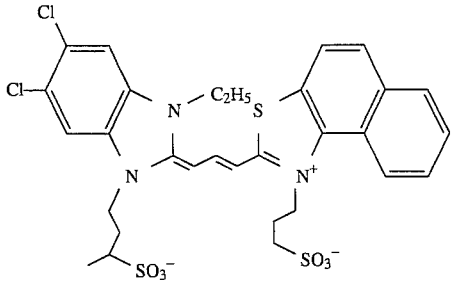
GSD-1:
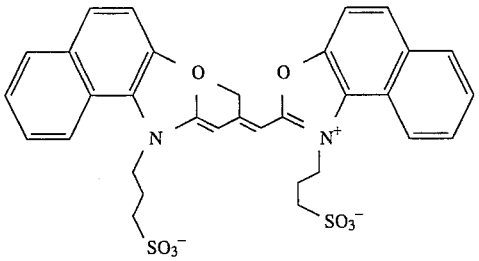
GSD-2:
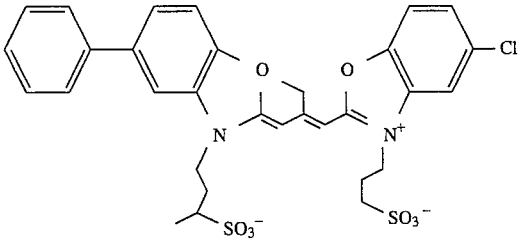
YSD-1:
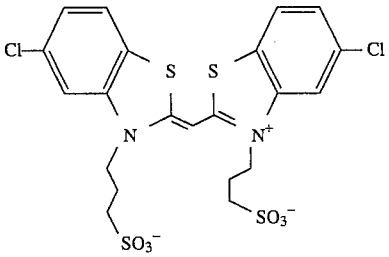
UV-1:
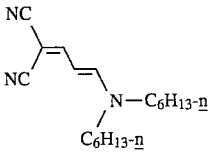
UV-2:
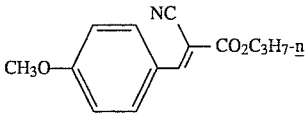

These experimental multilayer coatings were given a stepped exposure and processed in a developer as described for the single-layer elements.

Inventive Example 2

Inventive Example 2 was prepared in a similar manner as Comparative Example 1, except that the dispersion of MC-1 (dispersed in twice its weight in tricresylphosphate) in layers 5 and 6 was replaced with a co-dispersion of MC-1:N-1:tricresylphosphate at a weight ratio of 1:0.25:2 such that the laydown of MC-1 was the same. The results are shown in Table III.

Inventive Example 3

Inventive Example 3 was prepared in a similar manner as Comparative Example 1, except that the dispersion of MC-1 in layers 5 and 6 was replaced with a co-dispersion of MC-1:N-1:tricresylphosphate at a ratio of 1:1:1 such that the laydown of MC-1 was the same. The results are shown in Table III.

TABLE III

| Addenda | Green Density ar Minimum Exposure at Varied Times of Development (Status M) | | | |
|---|---|---|---|---|
| MC-1:N-1 | 3'15" | 4'15" | 6'15" | 10'15" |
| None (MC-1 only) | 0.744 | 0.768 | 0.948 | 1.552 |
| 1.0:0.25 | 0.739 | 0.768 | 0.906 | 1.371 |
| 1.0:1.0 | 0.739 | 0.757 | 0.874 | 1.209 |

As Table III shows, the amount of Green Dmin is greatly decreased using the nitro compound of the invention. Upon further testing, the presence of the nitro compound appeared to cause no adverse effect on other photographic properties.

What is claimed is:

1. A photographic element comprising a light sensitive silver halide emulsion layer containing as components dissolved in a coupler solvent: (1) an azopyrazolone masking coupler and (2) an aromatic nitro compound having a reduction peak potential that is more positive than −1.3 V vs. SCE and which is ballasted to insure that it remains dispersed in the coupler solvent.

2. The element of claim 1 wherein the reduction peak potential is more positive than −1.2 V.

3. The element of claim 1 wherein one or more of components (1) and (2) are dissolved in at least one solvent selected from the group consisting of tritolyl phosphate, diethyl docecamide, dibutyl phthalate, dibutyl dodecamide, didecyl phthalate, oleyl alcohol, dioctyl sebacate, trioctyl phosphite, and tri(2 -ethyl)hexyl phosphate.

4. The element of claim 1 wherein the aromatic nitro compound is present in a mole ratio of from 0.01 to 10.0:1.0 of masking coupler.

5. The element of claim 4 wherein the aromatic nitro compound is present in a mole ratio of from 0.02 to 4.0:1.0 of masking coupler.

6. The element of claim 1 wherein the ballasted aromatic nitro compound is in a codispersed state with the masking coupler.

7. The element of claim 1 wherein the aromatic nitro compound contains a substituent selected from —$SO_2$NRR' and —CONRR' where R and R' are independently hydrogen or a substituent selected from the group consisting of halogen; nitro; hydroxyl; cyano; —$CO_2$H; alkyl; alkenyl; alkoxy; aryl; aryloxy; carbonamido; sulfonamido; sulfamoyl; carbamoyl; sulfonyl; sulfonyloxy; sulfinyl; thio; acyloxy; amino; imino; phosphate; phosphite; azo; a heterocyclic group, heterocyclic oxy group or heterocyclic thio group, each of which comprise a 3 to 7 membered heterocyclic ring composed of carbon atoms and at least one hetero atom selected from the group consisting of oxygen, nitrogen and sulfur; quaternary ammonium; and silyloxy wherein the foregoing substituents may themselves be substituted with any of the above groups.

8. The element of claim 1 wherein the aromatic nitro compound has the formula:

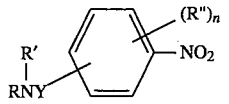

wherein Y is —$SO_2$— or —CO—; n is 0 to 4; R and R" are substituents and R' may be hydrogen or a substituent selected from the group consisting of halogen; nitro; hydroxyl; cyano; —$CO_2$H; alkyl; alkenyl; alkoxy; aryl; aryloxy; carbonamido; sulfonamido; sulfamoyl; carbamoyl; sulfonyl; sulfonyloxy; sulfinyl; thio; acyloxy; amino; imino; phosphate; phosphite; azo; a heterocyclic group, heterocyclic oxy group or heterocyclic thio group, each of which comprise a 3 to 7 membered heterocyclic ring composed of carbon atoms and at least one hetero atom selected from the group consisting of oxygen, nitrogen and sulfur; quaternary ammonium; and silyloxy; wherein the foregoing substituents may themselves be substituted with any of the above groups, all of such substituents selected so that the aromatic nitro compound has a reduction peak potential that is more positive than −1.3 V vs. SCE.

9. The element of claim 8 wherein the R and R' substituents of the ballasted aromatic nitro compound are independently selected from the group consisting of hydrogen and substituted or unsubstituted alkyl or aryl of up to 42 carbon atoms, wherein said substituted alkyl or aryl is substituted with a substituent selected from the group consisting of halogen; nitro; hydroxyl; cyano; —$CO_2$H; alkyl; alkenyl; alkoxy; aryl; aryloxy; carbonamido; sulfonamido; sulfamoyl; carbamoyl; sulfonyl; sulfonyloxy; sulfinyl; thio; acyloxy; amino; imino; phosphate; phosphite; azo; a heterocyclic group, heterocyclic oxy group or heterocyclic thio group, each of which comprise a 3 to 7 membered heterocyclic ring composed of carbon atoms and at least one hetero atom selected from the group consisting of oxygen, nitrogen and sulfur; quaternary ammonium; and silyloxy wherein the foregoing substituents may themselves be substituted with any of the above groups, and R" is suitably selected from the group consisting of halogen, nitro, cyano, carbonamido, carbamoyl, sulfonamido, sulfamoyl, sulfonyl, sulfinyl, acyl, or one of said substituents described for R, all containing up to 42 carbon atoms.

10. The element of claim 1 wherein the ballasted aromatic nitro compound contains a ballast group of at least 6 carbon atoms.

11. The element of claim 10 wherein the ballast group contains at least 8 carbon atoms.

12. The element of claim 1 wherein said layer has associated therewith an image coupler selected from the group consisting of the bicyclic azoles and the pyrazolones.

13. The element of claim 12 wherein the image coupler is selected from the group consisting of 1H-pyrazolo[ 3,2-c][1,2,4]-triazoles, 1H-pyrazolo[1,5 -b][1,2,4]-triazoles, the 3-anilino-5-pyrazolones and the 3-carbonamido-5-pyrazolones.

14. The element of claim 1 wherein the masking coupler is a para-substituted phenylazopyrazolone wherein the substituent in the para position is selected from the group consisting of halogen; nitro; hydroxyl; cyano; —$CO_2H$; alkyl; alkenyl; alkoxy; aryl; aryloxy; carbonamido; sulfonamido; sulfamoyl; carbamoyl; sulfonyl; sulfonyloxy; sulfinyl; thio; acyloxy; amino; imino; phosphate; phosphite; azo; a heterocyclic group, heterocyclic oxy group or heterocyclic thio group, each of which comprise a 3 to 7 membered heterocyclic ring composed of carbon atoms and at least one hetero atom selected from the group consisting of oxygen, nitrogen and sulfur; quaternary ammonium; and silyloxy wherein the foregoing substituents may themselves be substituted with any of the above groups.

15. The element of claim 1 wherein the masking coupler is represented by the formula:

$$Cp—N=N—R_3$$

wherein, Cp represents a 5-pyrazolone magenta coupler residual group where the azo group is attached at the 4-position of the magenta coupler, and $R_3$ represents a substituted or unsubstituted aryl group wherein said substituted aryl is substituted with a substituent selected from the group consisting of halogen; nitro; hydroxyl; cyano; —$CO_2H$; alkyl; alkenyl; alkoxy; aryl; aryloxy; carbonamido; sulfonamido; sulfamoyl; carbamoyl; sulfonyl; sulfonyloxy; sulfinyl; thio; acyloxy; amino; imino; phosphate; phosphite; azo; a heterocyclic group, heterocyclic oxy group or heterocyclic thio group, each of which comprise a 3 to 7 membered heterocyclic ring composed of carbon atoms and at least one hetero atom selected from the group consisting of oxygen, nitrogen and sulfur; quaternary ammonium; and silyloxy wherein the foregoing substituents may themselves be substituted with any of the above groups.

16. The element of claim 1 wherein the masking compound is selected from the compounds represented by MC-1 to MC-31 as follows:

MC-1

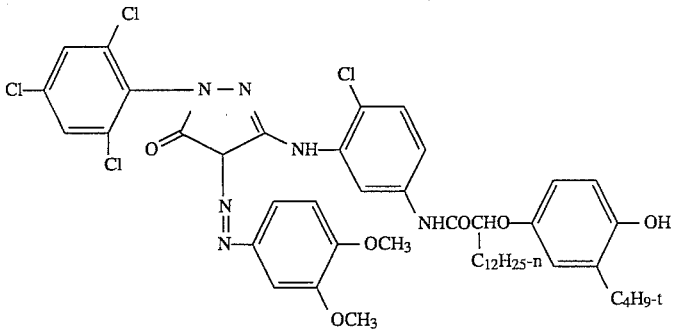

MC-2

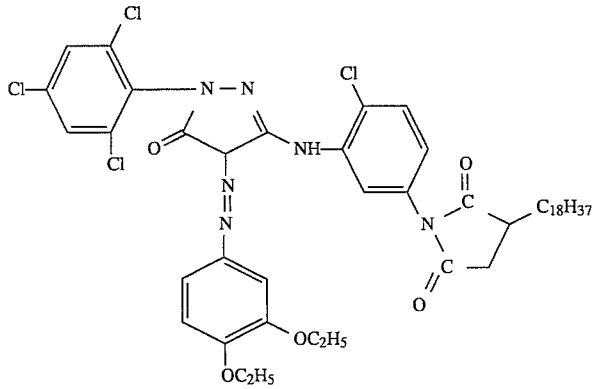

MC-3

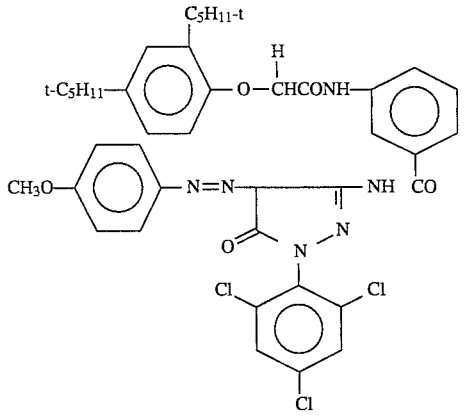

-continued
MC-4
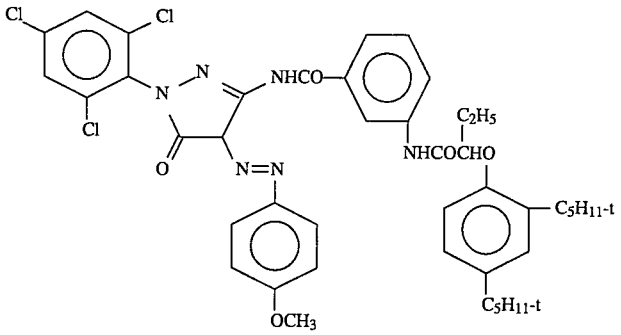
MC-5
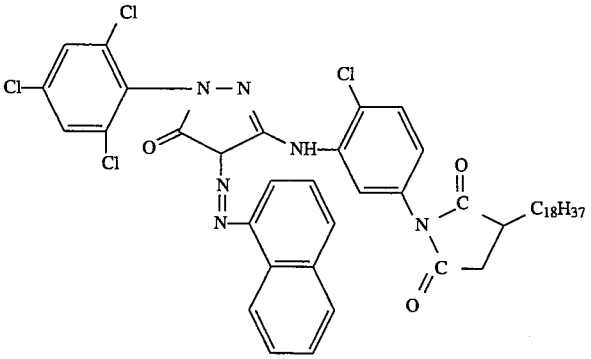
MC-6
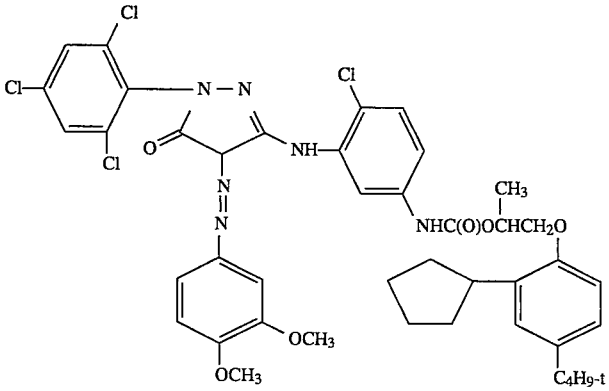
MC-7
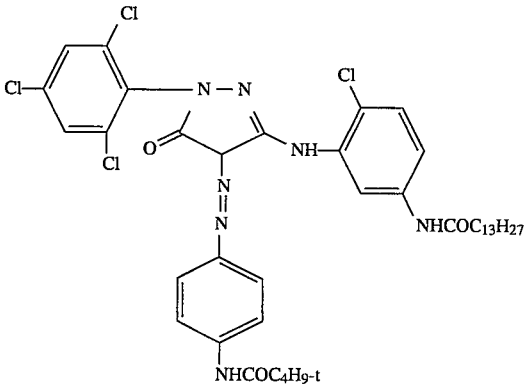

-continued
MC-8
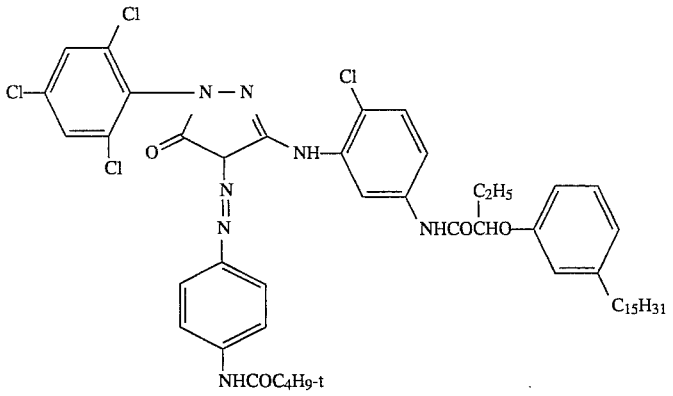
MC-9
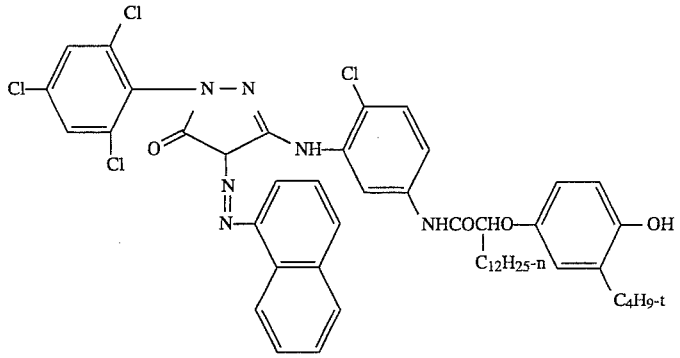
MC-10
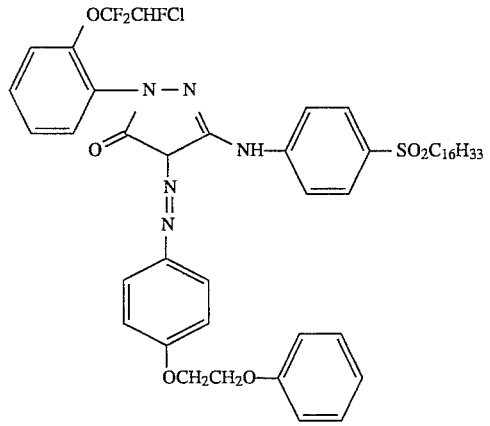
MC-11
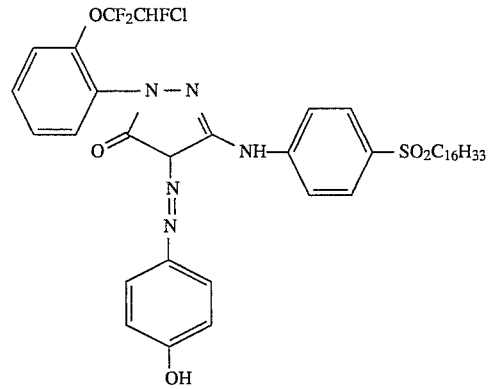

-continued
MC-12
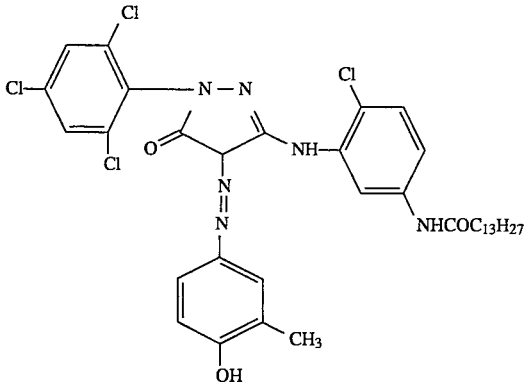
MC-13
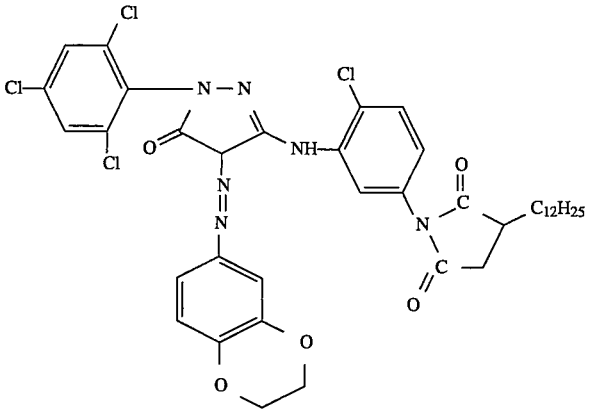
MC-14
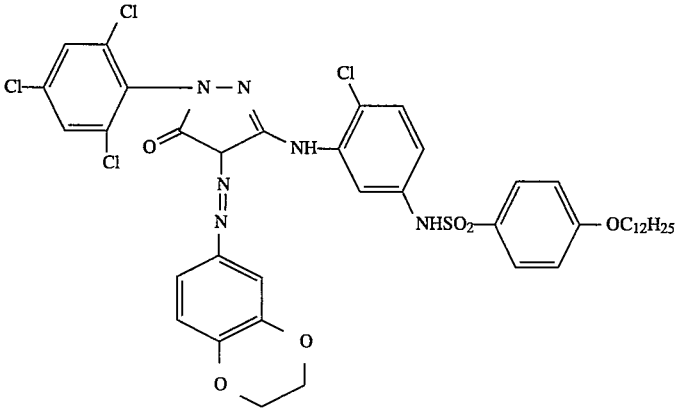
MC-15
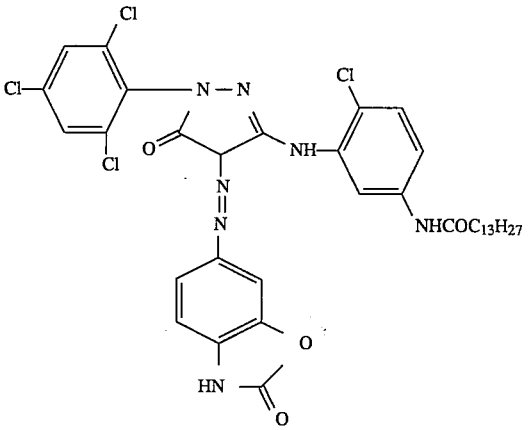

-continued
MC-16
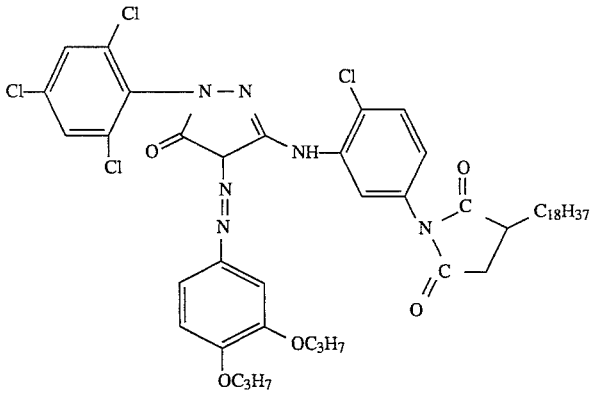
MC-17
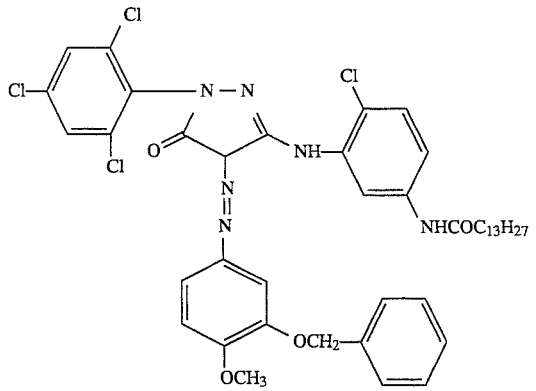
MC-18
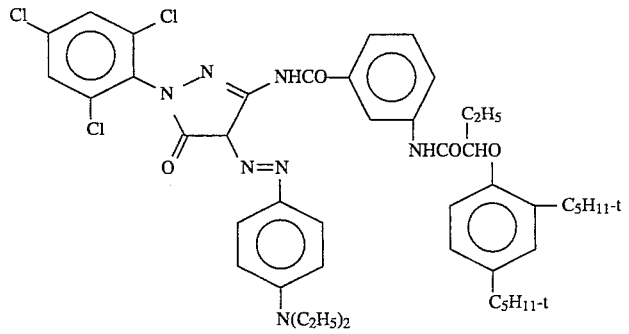
MC-19
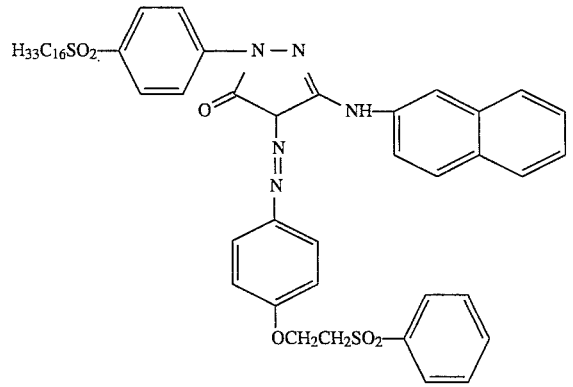

-continued
MC-20
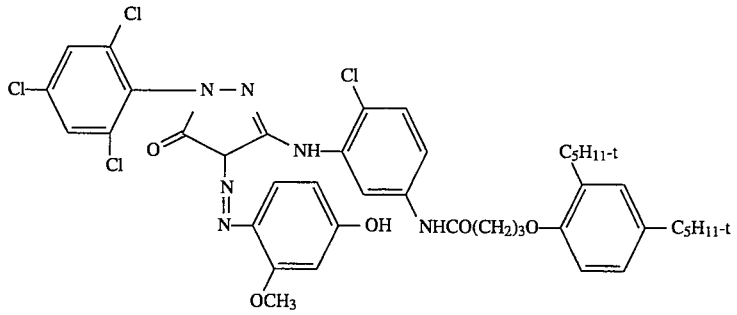
MC-21
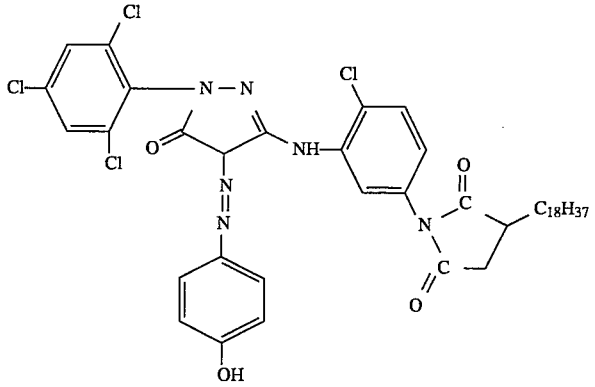
MC-22
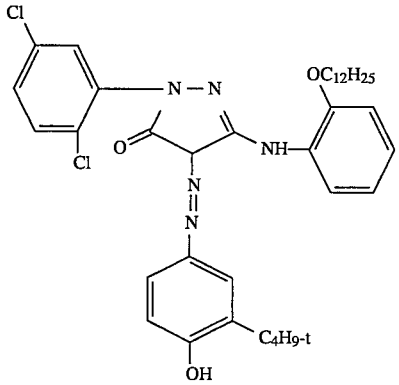
MC-23
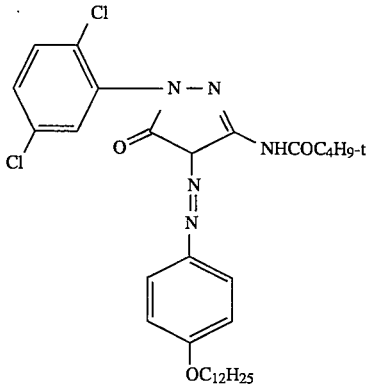

-continued
MC-24
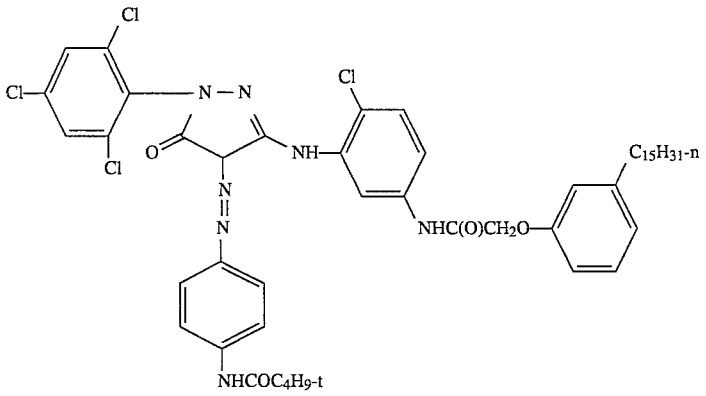
MC-25
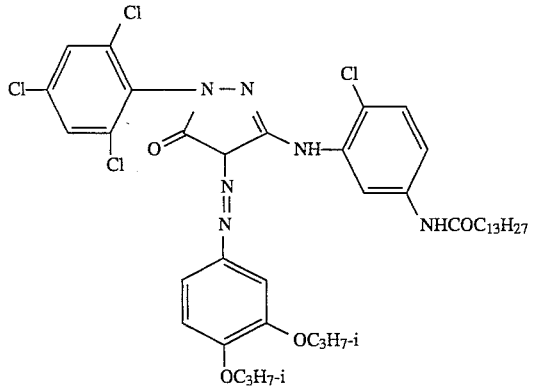
MC-26
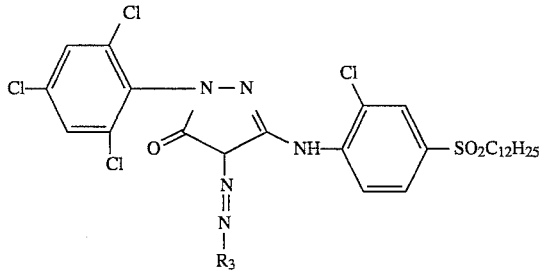
MC-27
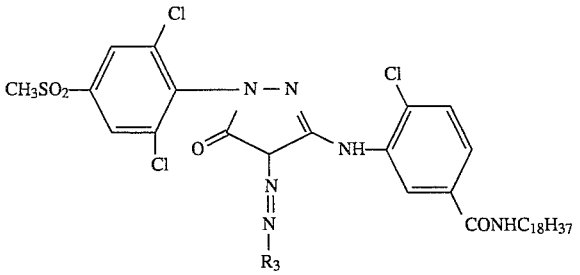
MC-28
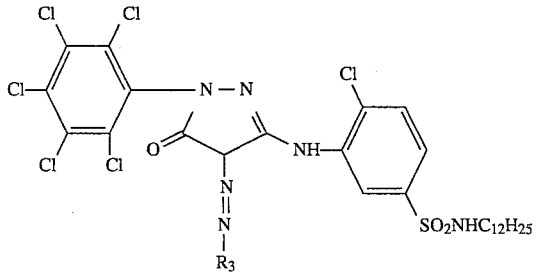

-continued
MC-29
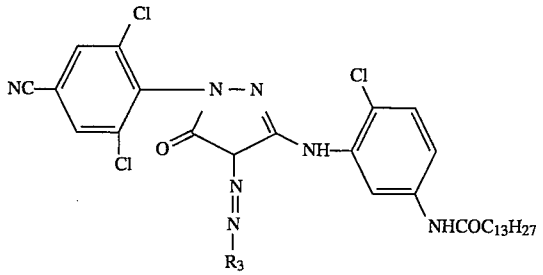
MC-30
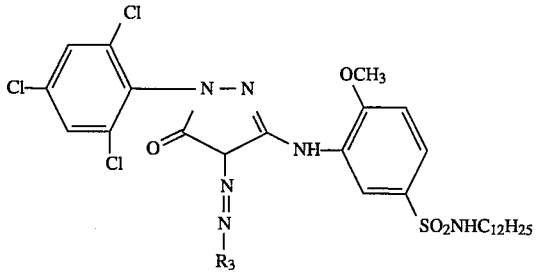
MC-31
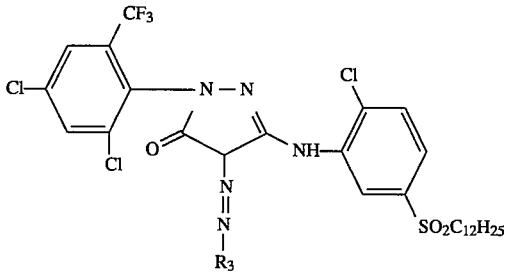
wherein, in the last six formulas, $R_3$ can be any one of the following:
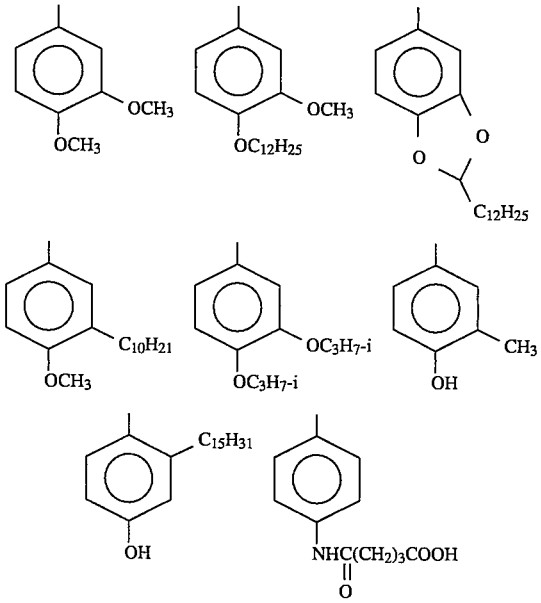
-continued
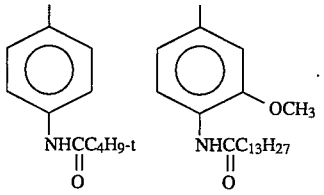
17. A process for developing an image from an exposed element as defined in claim 1, comprising contacting said exposed element with a color developing agent.
* * * * *